US007027968B2

(12) United States Patent
Choe et al.

(10) Patent No.: US 7,027,968 B2
(45) Date of Patent: Apr. 11, 2006

(54) METHOD FOR SIMULATING SUBSEA MUDLIFT DRILLING AND WELL CONTROL OPERATIONS

(75) Inventors: Jonggeun Choe, Seoul (KR); Hans C. Juvkam-Wold, College Station, TX (US)

(73) Assignee: ConocoPhillips Company, Houston, TX (US)

( * ) Notice: Subject to any disclaimer, the term of this patent is extended or adjusted under 35 U.S.C. 154(b) by 930 days.

(21) Appl. No.: 10/053,857

(22) Filed: Jan. 18, 2002

(65) Prior Publication Data

US 2003/0139916 A1 Jul. 24, 2003

(51) Int. Cl.
*G06G 7/48* (2006.01)

(52) U.S. Cl. ..... 703/10; 175/60; 702/6

(58) Field of Classification Search ..... 703/9, 703/10; 175/25, 38, 40, 48, 50, 65; 702/6; 73/152.18, 152.19, 152.2, 152.21, 152.22
See application file for complete search history.

(56) References Cited

U.S. PATENT DOCUMENTS 4,813,495 A 3/1989 Leach ..... 175/6
5,711,383 A * 1/1998 Terry et al. ..... 175/72
6,107,256 A * 8/2000 Udarbe et al. ..... 507/120
6,233,524 B1 * 5/2001 Harrell et al. ..... 702/9
6,612,382 B1 * 9/2003 King ..... 175/40
6,668,943 B1 * 12/2003 Maus et al. ..... 175/5
6,772,843 B1 * 8/2004 Nice et al. ..... 166/368

OTHER PUBLICATIONS

"A Modified Two-Phase Well-Control Model and Its Computer Applications as a Training and Educational Tool", Jonggeun Choe and Hans C. Juvkam-Wold, SPE Computer Applications, Feb. 1997, pp. 14-20, 8 pages.
"Table 4.6—Summary of Frictional Pressure Loss Equations", Applied Drilling Engineering, Adam T. Bourgoyne Jr. et al, SPE Textbook Series, vol. 2, 2 pages.
"Estimating Shallow Below Mudline Deepwater Gulf of Mexico Fracture Gradients", J. W. Barker et al., 1997 Houston AADE Chapter Annual Technical Forum, Apr. 2-3, 1997, 9 pages.
"Fracture Gradient Prediction and Its Application in Oilfield Operations", Ben A. Eaton, Journal of Petroleum Technology, Oct. 1969, 8 pages.

(Continued)

*Primary Examiner*—Albert W. Paladini
(74) *Attorney, Agent, or Firm*—Osha Liang LLP

(57) ABSTRACT

A method of simulating subsea mudlift drilling well control operations using a computer system. The method includes simulating a drilling circulation system. The simulation includes simulating drilling the wellbore at a selected rate of penetration, and the simulating drilling a wellbore includes simulating drilling selected earth formations. A kick is simulated at a selected depth in the wellbore, and the kick is simulated as a two-phase mixture including drilling fluid and a formation fluid. Controlling the kick is then simulated, and wellbore parameters are displayed via a graphical user interface connected to the computer system. The simulating drilling the wellbore is then repeated after the kick has been controlled.

31 Claims, 15 Drawing Sheets

OTHER PUBLICATIONS

"Fracture Gradient Prediction For The New Generation", Dr. Ben A. Eaton et al., World Oil, Oct. 1997, 5 pages.
"Compressibility Factors for High-Molecular-Weight Reservoir Gases", R. P. Sutton, Society of Petroleum Engineerings Paper No. SPE 14265, 16 pages.
"Calculation of Z Factors For Natural Gases Using Equations of State", P. M. Dranchuk et al., The Journal of Canadian Petroleum, 3 pages.
"Two-Phase Flow In Pipes", Dr. James P. Brill et al., Third Printing Feb., 1984, 3 pages.
"The Viscosity of Natural Gases", Anthony L. Lee et al., Reprint from Aug. 1966 Journal of Petroleum Technology, 4 pages.
"A Study of Two-Phase Flow in Inclined Pipes", H. Dale Beggs et al., Journal of Petroleum Technology, May 1973, 11 pages.
"Velocity of Large Drops and Bubbles in Media of Infinite or Restricted Extent", Tibor Z. Harmathy, A.I.Ch.E. Journal, vol. 6, No. 2, Jun. 1960, 8 pages.
"Predicting Multiphase Flow Behavior in a Deviated Well", A. Rashid Hasan et al., SPE Production Engineering, Nov. 1988, 9 pages.
"A Study of Multiphase Flow Behavior in Vertical Oil Wells: Part I—Theoretical Treatment", A. R. Hasan et al., Society of Petroleum Engineers, Paper No. SPE 15138, 16 pages.
"Well Testing", John Lee, First Printing, Society of Petroleum Engineers of AIME, New York, Dallas, 1982, 2 pages.
"Dynamic Well Control Simulation Models for Water-Based MUDS and Their Computer Applications", Dissertation by Jonggeun Choe, May 1995, 197 pages.
Advertisement by Stress Engineering Services, Inc., "SES Now Offers TIARA Marine Riser Analysis Software", dated 1995.
Advertisement by Williams Tool Company, Inc. for a "Virtual Rise" dated 1998.
Publication by Statoil "Deep Sea Drilling Methods, A Survey of Methods Competing and Supplementing the Atlantis Drilling System" dated Mar. 1999.
Article by Schubert et al. "Greater Kick Tolerance and Fewer Casing Strings Make Dual Gradient Drilling a Winner" dated Aug. 25-26, 1999.
Publication by Allen Gault "Conoco, Hydril project seek enabling technologies to drill in deepest water depths economically" dated May 1996.
Publication by Efthim and Peterman "Riserless drilling JIP moving to second phase-development" dated Dec. 1997.
"Feasibility Study for riserless drilling/return line drilling and novel drilling methods" prepared by Conoco Hydril, JIP Project proposal.
Publication/Advertisement by Conoco and ABB Vetco Gray "Shallow Water Follow Diverter System".

* cited by examiner

Required Data Input

File

Fluid Data | Conditions | Formation Properties | Well Geometry | Trip Conditions Fluid Model: Power-Law Old Mud Weight: 15.50 ppg Critical Reynolds Number: 2,100.00

Roughness of Drill-String: 0.00 in (NOTE: Only used with Bingham plastic model)

Gas Specific Gravity (air = 1.0): 0.65

Mole Fraction of CO2 in Gas Kick:

Mole Fraction of H2S in Gas Kick:

Surface Temperature: 70.00 deg F

Mud Temperature Gradient: 1.00 deg F/100 ft

Water Temperature Gradient: -0.90 deg F/100 ft

Input Data Type

Shear Stress Reading

Shear Stress Reading @ 300 rpm: 65.00

Shear Stress Reading @ 600 rpm: 111.00

Plastic Viscocity

Plastic Viscocity: 46.00

Yield Point Stress: 19.00

Bit Nozzle Diameter 16.00 in/32nd 16.00 in/32nd 16.00 in/32nd 0.00 in/32nd

OK | Cancel

FIG. 4

Table 2 – Surface Tension of Water-Gas System

| Pressure (psia) | Surface tension (dynes/cm) 74 °F | 280 °F |
|---|---|---|
| 0 | 75 | 53 |
| 1000 | 63 | 46 |
| 2000 | 59 | 40 |
| 3000 | 57 | 33 |
| 4000 | 54 | 26 |
| 5000 | 52 | 21 |
| 6000 | 52 | 21 |
| 7000 | 51 | 22 |
| 8000 | 50 | 23 |
| 9000 | 49 | 24 |

FIG 5

METHOD FOR SIMULATING SUBSEA MUDLIFT DRILLING AND WELL CONTROL OPERATIONS

BACKGROUND OF INVENTION

1. Technical Field

The invention relates generally to methods and procedures for simulating well control methods and procedures where "riserless" drilling systems are used.

2. Background Art

Exploration companies are continually searching for methods to make deep water drilling commercially viable and more efficient. Conventional drilling techniques are not feasible in water depths of over several thousand feet. Deep water drilling produces unique challenges for drilling aspects such as well pressure control and wellbore stability. Some of the challenges are described in detail below.

Deep Water Drilling

Deep water drilling techniques have, in the past, typically relied on the use of a large diameter marine riser to connect drilling equipment on a floating vessel or a drilling platform to a blowout preventer stack on a subsea wellhead disposed on the seafloor. The primary functions of the marine riser are to guide a drill string and other tools from the floating vessel to the subsea wellhead and to conduct drilling mud and earth cuttings from the subsea well back to the floating vessel. In deeper waters, conventional marine riser technology encounters severe difficulties. For example, if a deep water marine riser is filled with drilling mud, the drilling mud in the riser may account for a majority of the drilling mud in the circulation system. As water depth increases, the drilling mud volume in the riser increases. The large volume of drilling mud requires a very large circulation system and drilling vessel. In addition, the hydrostatic pressure exerted by the mud riser column can frequently exceed the fracture pressure of sediments just below the sea floor. Moreover, an extended length riser may experience high loads from ocean currents and waves. The energy from the currents and waves may be transmitted to the drilling vessel and may damage both the riser and the vessel.

In order to overcome problems associated with deep water drilling, a technique known as "riserless" drilling has been developed. Not all riserless techniques operate without a marine riser. The marine riser may still be used for the purpose of guiding the drill string to the wellbore and for protecting the drill string and other lines that run to and from the wellbore. When marine risers are used, however, they typically are filled with seawater rather than drilling mud. The seawater has a density that may be substantially less than that of the drilling mud, substantially reducing the hydrostatic pressure in the drilling system.

An example of a "riserless" drilling system is shown in U.S. Pat. No. 4,813,495 issued to Leach and assigned to the assignee of the present invention. A riserless drilling system 10 of the '495 patent is shown in FIG. 1 and comprises a drill string 12 including drill bit 20 and positive displacement mud motor 30. The drill string 12 is used to drill a wellbore 13. The system 10 also includes blowout preventer stack 40, upper stack package 60, mud return system 80, and drilling platform 90. As drilling is initiated, drilling mud is pumped down through the drill string 12 through drilling mud line 98 by a pump which forms a portion of mud processing unit 96. The drilling mud flow operates mud motor 30 and is forced through the bit 20. The drilling mud is forced up a wellbore annulus 13A and is then pumped to the surface through mud return system 80, mud return line 82, and subsea mudlift pump 81. This process differs from conventional drilling operations because the drilling mud is not forced upward to the surface through a marine riser annulus.

The blowout preventer stack 40 includes first and second pairs of ram preventers 42 and 44 and annular blowout preventer 46. The blowout preventers ("BOP"s) may be used to seal the wellbore 13 and prevent drilling mud from travelling up the annulus 13A. The ram preventers 42 and 44 include pairs of rams (not shown) that may seal around or shear the drill string 12 in order to seal the wellbore 13. The annular preventer 46 includes an annular elastomeric member that may be activated to sealingly engage the drill string 12 and seal the wellbore 13. The blowout preventer stack 40 also includes a choke/kill line 48 with an adjustable choke 50. The choke/kill line 48 provides a flow path for drilling mud and formation fluids to return to the drilling platform 90 when one or more of the BOPs (42, 44, and 46) have been closed.

The upper end of the BOP stack 40 may be connected to the upper stack package 60 as shown in FIG. 1. The upper stack package 60 may be a separate unit that is attached to the blowout preventer stack 40, or it may be the uppermost element of the blowout preventer stack 40. The upper stack package 60 includes a connecting point 62 to which mud return line 82 is connected. The upper stack package 60 may also include a rotating head 70. The rotating head 70 may be a subsea rotating diverter ("SRD") that has an internal opening permitting passage of the drill string 12 through the SRD. The SRD forms a seal around the drill string 12 so that the drilling mud filled annulus 13A of the wellbore 13 is hydraulically separated from the seawater. The rotating head 70 typically includes both stationary elements that attach to the upper stack package 40 and rotating elements that sealingly engage and rotate with the drill string 12. There may be some slippage between rotating elements of the rotating head 70 and the drill string 12, but the hydraulic seal is maintained. During drill pipe "trips" to change the bit 20, the rotating head 70 is typically tripped into the hole on the drill string 12 before fixedly and sealingly engaging the upper stack package 60 that is connected to the BOP stack 40.

The lower end of the BOP stack 40 may be connected to a casing string 41 that is connected to other elements (such as casing head flange 43 and template 47) that form part of a subsea wellhead assembly 99. The subsea wellhead assembly 99 is typically attached to conductor casing that may be cemented in the first portion of the wellbore 13 that is drilled in the seafloor 45. Other portions of the wellbore 13, including additional casing strings, well liners, and open hole sections extend below the conductor casing.

The mud return system 80 includes the subsea mudlift pump 81 that is positioned in the mud return line 82 adjacent to the upper stack package 60. The subsea mudlift pump 81 in the '495 patent is shown as a centrifugal pump that is powered by a seawater driven turbine 83 that is, in turn, driven by a seawater transmitting powerfluid line 84. The mud return system 80 boosts the flow of drilling mud from the seafloor 45 to the drilling mud processing unit 96 located on the drilling platform 90. Drilling mud is then cleaned of cuttings and debris and recirculated through the drill string 12 through drilling mud line 98.

Subsea Well Control

When drilling a well, particularly an oil or gas well, there exists the danger of drilling into a formation that contains fluids at pressures that are greater than the hydrostatic fluid pressure in the wellbore. Generally, when this occurs, the higher pressure formation fluids flow into the well and increase the fluid volume and decrease the fluid pressure in the wellbore. However, other situations may exist as well. For example, if the formation fluid influx occurs while operating a subsea mudlift pump at a substantially constant inlet pressure, the influx will generally increase the flow rate in the annulus by an amount equal to the influx rate. This generally results in an increase in a frictional pressure drop in the annulus and a corresponding increase in wellbore pressure above the influx location. In some instances, the bottom hole pressure will decrease because of, for example, a lower density of the influx fluid. Moreover, if the influx rate is very high, the bottom hole pressure may initially increase and then decrease as additional influx fluid enter the wellbore.

The influx of formation fluids may displace the drilling mud and cause the drilling mud to flow up the wellbore toward the surface. The formation fluid influx and the flow of drilling and formation fluids toward the surface is known as a "kick." If the kick is not subsequently controlled, the result may be a "blowout" in which the influx of formation fluids (which, for example, may be in the form of gas bubbles that expand near the surface because of the reduced hydrostatic pressure) blows the drill string out of the well or otherwise destroys a drilling apparatus. An important consideration in deep water drilling is controlling the influx of formation fluid from subsurface formations into the well to control kicks and prevent blowouts from occurring.

Drilling operations typically involve maintaining the hydrostatic pressure of the drilling mud column above the formation fluid pressure. This is typically done by selecting a specific drilling mud density and is typically referred to as "overbalanced" drilling. At the same time, however, the bottom hole pressure of the drilling mud column must be maintained below a formation fracture pressure. If the bottom hole pressure exceeds the formation fracture pressure, the formation may be damaged or destroyed and the well may collapse around the drill string.

A different type of drilling regime, known as "underbalanced" drilling, may be used to optimize the rate of penetration ("ROP") and the efficiency of a drilling assembly. In underbalanced drilling, the hydrostatic pressure of the drilling mud column is typically maintained lower than the fluid pressure in the formation. Underbalanced drilling encourages the flow of formation fluids into the wellbore. As a result, underbalanced drilling operations must be closely monitored because formation fluids are more likely to enter the wellbore and induce a kick.

Once a kick is detected, the kick is typically controlled by "shutting in" the wellbore and "circulating out" the formation fluids that entered the wellbore. Referring again to FIG. 1, a well is typically shut in by closing one or more BOPs (42, 44, and/or 46). The fluid influx is then circulated out through the adjustable choke 50 and the choke/kill line 48. The choke 50 is adjustable and may control the fluid pressure in the well by allowing a buildup of back pressure (caused by pumping drilling mud from the mud processing unit 96) so that the kick may be circulated through the drilling mud processing unit 96 in a controlled process. The drilling mud processing unit 96 has elements that may remove any formation fluids, including both liquids and gases, from the drilling mud. The drilling mud processing unit 96 then recirculates the "cleaned" drilling mud back through the drill string 12. Typically, as the kick is circulated out, the drilling mud that is being pumped back into the wellbore 13 through drill string 12 has an increased density of a preselected value. The resulting increased hydrostatic pressure of the drilling mud column may equal or exceed the formation pressure at the site of the kick so that further kicks are prevented. This process is referred to as "killing the well." The kick is circulated out of the wellbore and the drilling mud density is increased in substantially one complete circulation cycle. For example, by the time the last remnants of the drilling mud with the pre-kick mud density have been circulated out of the well, mud with the post-kick mud density has been circulated in as a substitute. When the wellbore is stabilized, drilling operations may be resumed or the drill string 12 may be tripped out of the wellbore 13. This method of controlling a kick is typically referred to as the "Wait and Weight" method. The Wait and Weight Method has historically been the preferred method of circulating out a kick because it generally exerts less pressure on the wellbore 13 and the formation, and requires less circulating time to remove the influx from the drilling mud.

Another method for controlling a kick is typically referred to as the "Driller's Method." Generally, the Driller's Method is accomplished in two steps. First, the kick is circulated out of the wellbore 13 while maintaining the drilling mud at an original density ("mud weight"). This process typically takes one complete circulation of the drilling mud in the wellbore 13. Second, drilling mud with a higher mud weight is then pumped into the wellbore 13 to overcome the higher formation pressure that produced the kick. Therefore, the Driller's Method may be referred to as a "two circulation kill" because it typically requires at least two complete circulation cycles of the drilling mud in the wellbore 13 to complete the process.

A device known as a drill string valve ("DSV") may be used as a component of either of the previously referenced well control methods. A DSV is typically located near a bottom hole assembly and includes a spring activated mechanism that is sensitive to the pressure inside the drill string. When drill string pressure is lowered below a preselected level, the spring activates a flow cone that moves to block flow ports in a flow tube. In order for drilling mud to flow through the drill string, the flow ports must be at least partially open. Thus, the DSV permits flow through the drill string if sufficient surface pump pressure is applied to the drilling fluid column, and the DSV typically only permits flow in one direction so that it acts as a check valve against mud flowing back toward the surface.

The spring pressure in the DSV may be adjusted to account for factors such as the depth of the wellbore, the hydrostatic pressure exerted by the drilling mud column, the hydrostatic pressure exerted by the seawater from a drilling mud line to the surface, and the diameter of drill pipe in the drill string. The drilling mud line may be defined as a location in a well where a transition from seawater to drilling mud occurs. For example, in the system 10 shown in FIG. 1, the drilling mud line is defined by the hydraulic seal of the rotating head 70 that separates the drilling mud of the wellbore annulus 13A from seawater. The DSV may be used to stop drilling mud from experiencing "free-fall" when the mud circulation pumps are shut down and the well is shut-in.

Using the system of the Leach '495 patent as an example, when the pumps of the mud processing unit 96 are shut down and no DSV is present in the drill string 12, the mud column hydrostatic pressure in the drill string 12 is greater than the sum of the hydrostatic pressure of the drilling mud in the wellbore annulus 13A and a suction pressure generated by the subsea mudlift pump 81. Drilling mud, therefore, free-falls in the drill string into the wellbore annulus 13A until the hydrostatic pressure of the mud column in the drill string 12 is equalized with the sum of the hydrostatic pressure of the drilling mud in the wellbore annulus 13A and the mudlift pump 81 suction pressure. Thus, the well continues to flow while equilibrium is established. The continued flow of drilling mud in the well after pump shut-down may typically be referred to as an "unbalanced U-tube" effect. The DSV, which should be in a closed position after the pumps are shut-down, may prevent the free-fall of drilling mud in the wellbore that may be attributable to the unbalanced U-tube.

In contrast, in conventional drilling systems where drilling mud is returned to the surface through the wellbore annulus, the drilling mud circulation system forms a "balanced U-tube" because there is no flow of drilling mud in the well after the surface pumps are shut down. The well does not flow because the hydrostatic pressure of the drilling mud in the drill string is balanced with the hydrostatic pressure of the mud in the wellbore annulus.

Well control procedures may be complicated by a leaking DSV. For example, the spring in the DSV must be adjusted correctly so that it will activate the flow cone and block the flow ports when pressure is removed from the mud column such as by shutting down the surface mud pumps. If the flow ports remain at least partially open, the well will continue to flow after all the pumps have been shut down and/or after the well has been fully shut-in. If the flow is caused by a leaking DSV, it is difficult to distinguish leakage from an additional kick influx in the wellbore. Further, the DSV may develop leaks from flow erosion, corrosion, or other factors.

Typically, there are two conditions where the DSV may be checked for leaks. The first condition is during normal drilling operations when, for example, circulation of drilling mud is stopped so that a drill pipe connection may be made (all pumps must be shut off for the DSV check). In this case, an effort is made to distinguish between a leaking DSV and a possible kick. The second condition occurs after the well has been fully shut-in on a kick (again, all pumps must be shut off for the DSV check). In this case, an effort is made to distinguish between leaking DSV and additional flow that may have entered the well from the known kick. In both cases it is important to check the DSV for leaks because otherwise it may be difficult to determine if additional flow in the well is due to a leaking or partially open DSV or to additional flow that has entered the well from a kick.

The above discussion show only a few of the challenges associated with riserless drilling. What is needed, therefore, are methods and apparatus for simulating these challenges (such as a kick) to train operators and to design and optimize subsea mudlift drilling equipment so that the inherent dangers associated with riserless drilling may be reduced.

SUMMARY OF INVENTION

In one aspect, the invention comprises a method of simulating subsea mudlift drilling well control operations using a computer system, the method comprising simulating a drilling circulation system. The simulated circulation system comprises at least one blowout preventer, at least one isolation line, at least one surface pump, a subsea mudlift pump, drill pipe, drilling fluid, and a wellbore. Drilling the wellbore is simulated at a selected rate of penetration, and the simulating drilling the wellbore comprises simulating drilling selected earth formations. A kick is simulated at a selected depth in the wellbore proximate a selected earth formation, and the kick is simulated as a two-phase mixture comprising drilling fluid and a formation fluid.

Controlling the kick is simulated, and the simulating controlling the kick comprises simulating shutting the at least one blowout preventer, simulating opening the at least one isolation line, and simulating circulating a formation fluid influx out of a well while an inlet pressure of a subsea mudlift pump is adjusted to maintain a substantially constant drill pipe initial circulating pressure. Controlling the kick further comprises simulating pumping drilling fluid with a kill mud weight from the surface into the well, simulating reducing the drill pipe pressure according to a preselected drill pipe pressure decline schedule until the kill mud weight drilling fluid reaches a bottom of the well, simulating maintaining the drill pipe pressure at a final circulating pressure after the kill mud weight drilling fluid reaches the bottom of the well by adjusting the inlet pressure of the subsea mudlift pump, and simulating circulating kill mud weight drilling fluid from the bottom of the well to the surface at the final circulating pressure.

Wellbore parameters are displayed via a graphical user interface operatively coupled to the computer system, the wellbore parameters comprising a drill pipe pressure, a subsea mudlift pump inlet pressure, a surface pump flow rate, a subsea mudlift pump flow rate, a formation pressure, a blowout preventer status, an isolation line status, a drilling fluid density, and a kill mud weight drilling fluid density. The simulating drilling the wellbore is repeated after the kick has been controlled.

In another aspect, the invention comprises a method of performing real-time well control operations, the method comprising simulating a drilling circulation system. The simulated circulation system comprises at least one blowout preventer, at least one isolation line, at least one surface pump, a subsea mudlift pump, drill pipe, drilling fluid, and a wellbore. Drilling the wellbore is simulated at a selected rate of penetration, and the simulating drilling the wellbore comprises simulating drilling selected earth formations. A kick is simulated at a selected depth in the wellbore proximate a selected earth formation, and the kick is simulated as a two-phase mixture comprising drilling fluid and a formation fluid.

Controlling the kick is simulated, and the simulating controlling the kick comprises simulating shutting the at least one blowout preventer, simulating opening the at least one isolation line, and simulating circulating a formation fluid influx out of a well while an inlet pressure of a subsea mudlift pump is adjusted to maintain a substantially constant drill pipe initial circulating pressure. Controlling the kick further comprises simulating pumping drilling fluid with a kill mud weight from the surface into the well, simulating reducing the drill pipe pressure according to a preselected drill pipe pressure decline schedule until the kill mud weight drilling fluid reaches a bottom of the well, simulating maintaining the drill pipe pressure at a final circulating pressure after the kill mud weight drilling fluid reaches the bottom of the well by adjusting the inlet pressure of the subsea mudlift pump, and simulating circulating kill mud weight drilling fluid from the bottom of the well to the surface at the final circulating pressure.

Wellbore parameters are displayed via a graphical user interface operatively coupled to the computer system, the wellbore parameters comprising a drill pipe pressure, a subsea mudlift pump inlet pressure, a surface pump flow rate, a subsea mudlift pump flow rate, a formation pressure, a blowout preventer status, an isolation line status, a drilling fluid density, and a kill mud weight drilling fluid density. The displayed parameters are used to operate the drilling circulation system.

In another aspect, the invention comprises a method of simulating subsea mudlift drilling well control operations using a computer system, the method comprising simulating a drilling circulation system. The simulated circulation system comprises at least one blowout preventer, at least one isolation line, at least one surface pump, a subsea mudlift pump, drill pipe, drilling fluid, and a wellbore. Drilling the wellbore is simulated at a selected rate of penetration, and the simulating drilling the wellbore comprises simulating drilling selected earth formations. A kick is simulated at a selected depth in the wellbore proximate a selected earth formation, and the kick is simulated as a two-phase mixture comprising drilling fluid and a formation fluid.

Controlling the kick is simulated, and the simulating controlling the kick comprises simulating shutting the at least one blowout preventer, simulating opening the at least one isolation line, simulating circulating a formation fluid influx out of a well while an inlet pressure of a subsea mudlift pump is adjusted to maintain a substantially constant drill pipe initial circulating pressure, simulating pumping drilling fluid with a kill mud weight from the surface into the well. The controlling the kick further comprises simulating holding the inlet pressure of the subsea mudlift pump substantially constant until the kill mud weight drilling fluid reaches a bottom of the well, simulating adjusting the inlet pressure of the subsea mudlift pump to maintain the drill pipe pressure at a final circulating pressure after the kill mud weight drilling fluid reaches the bottom of the well, and simulating circulating kill mud weight drilling fluid from the bottom of the well to the surface at the final circulating pressure.

Wellbore parameters are displayed via a graphical user interface operatively coupled to the computer system, the wellbore parameters comprising a drill pipe pressure, a subsea mudlift pump inlet pressure, a surface pump flow rate, a subsea mudlift pump flow rate, a formation pressure, a blowout preventer status, an isolation line status, a drilling fluid density, and a kill mud weight drilling fluid density. The simulating drilling the wellbore is repeated after the kick has been controlled.

In another aspect, the invention comprises a method of performing real-time well control operations, the method comprising simulating a drilling circulation system. The simulated circulation system comprises at least one blowout preventer, at least one isolation line, at least one surface pump, a subsea mudlift pump, drill pipe, drilling fluid, and a wellbore. Drilling the wellbore is simulated at a selected rate of penetration, and the simulating drilling the wellbore comprises simulating drilling selected earth formations. A kick is simulated at a selected depth in the wellbore proximate a selected earth formation, and the kick is simulated as a two-phase mixture comprising drilling fluid and a formation fluid.

Controlling the kick is simulated, and the simulating controlling the kick comprises simulating shutting the at least one blowout preventer, simulating opening the at least one isolation line, simulating circulating a formation fluid influx out of a well while an inlet pressure of a subsea mudlift pump is adjusted to maintain a substantially constant drill pipe initial circulating pressure, simulating pumping drilling fluid with a kill mud weight from the surface into the well. The controlling the kick further comprises simulating holding the inlet pressure of the subsea mudlift pump substantially constant until the kill mud weight drilling fluid reaches a bottom of the well, simulating adjusting the inlet pressure of the subsea mudlift pump to maintain the drill pipe pressure at a final circulating pressure after the kill mud weight drilling fluid reaches the bottom of the well, and simulating circulating kill mud weight drilling fluid from the bottom of the well to the surface at the final circulating pressure.

Wellbore parameters are displayed via a graphical user interface operatively coupled to the computer system, the wellbore parameters comprising a drill pipe pressure, a subsea mudlift pump inlet pressure, a surface pump flow rate, a subsea mudlift pump flow rate, a formation pressure, a blowout preventer status, an isolation line status, a drilling fluid density, and a kill mud weight drilling fluid density. The displayed parameters are used to operate the drilling circulation system.

Other aspects and advantages of the invention will be apparent from the following description and the appended claims.

BRIEF DESCRIPTION OF DRAWINGS

FIG. 4 shows a graphical user interface according to an embodiment of the invention.

FIG. 5 shows a table used to determine a surface tension in a gas-drilling fluid volume according to an embodiment of the invention.

DETAILED DESCRIPTION

The present invention relates to a method for simulating riserless subsea mudlift drilling (SMD) operations. One embodiment of the invention comprises a simulation that may be programmed as a set of software subroutines that, in turn, may be used with any suitable computer system so as to simulate SMD operations. Embodiments of the simulation comprise multiple subroutines that are linked together through a common interface and database that includes either simulated or real-time data concerning wellbore characteristics and properties. The subroutines enable the simulation to accurately model drilling operations and wellbore kicks (including detailed well control procedures). As referred to herein, the subroutines may be programmed in any suitable format including, in some embodiments, Visual Basic, and the subroutines may be adapted to be run on one or more computers or as "virtual machines" running on a computer system.

Simulations are performed, for example, by running the interconnected subroutines through an application interface. The interface permits users (or another automated system coupled to the interface) to input simulated wellbore data, which may include actual data measured from existing wellbores. In this manner, the SMD simulation may be used to model both planned and existing wells so as to develop well control processes, to improve SMD hydraulics, and the like. Moreover, real-time data may be input from existing wells so that the SMD simulation provides a real-time model of current well characteristics. In this manner, for example, well control problems may be prevented by detecting changes in well properties and characteristics in real-time. Note that, as used herein, the term "real-time" includes both actual real-time data and substantially real-time data that may be received, for example, after a relatively small time delay.

The following discussion describes a typical SMD system and then outlines various subroutines and calculations used to simulate the SMD and well control procedures associated therewith. The SMD simulation comprises a tool for training well control operators, a tool for planning wells, a tool for developing improved well hydraulics, and as a real-time platform for both simulating and controlling an operating well and well circulation system. These and other aspects of the invention are described in detail below.

Subsea Mudlift Drilling System

Figure 1:
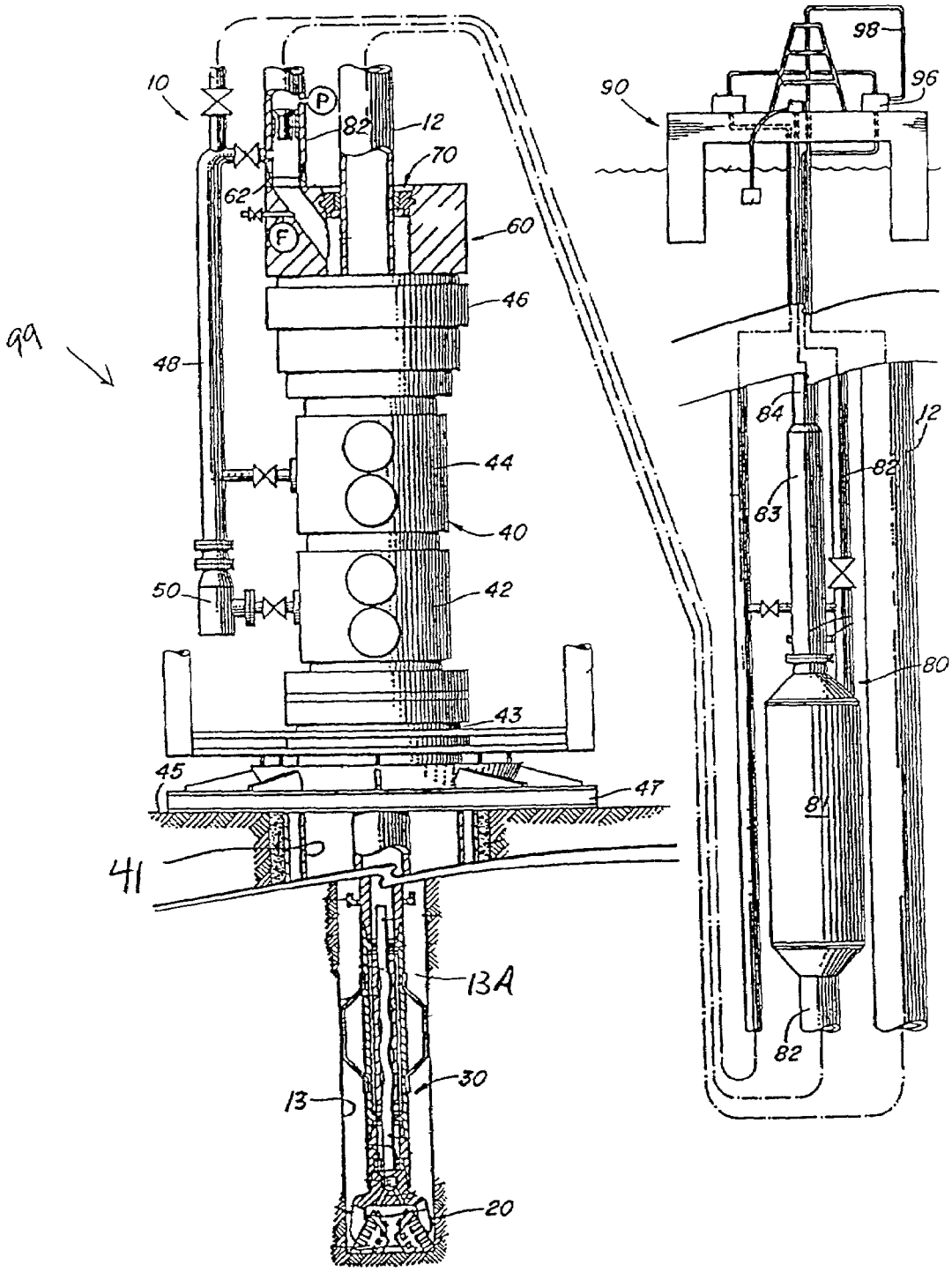
FIGURE 1 (PRIOR ART)
FIG. 1 shows an example of a prior art riserless drilling system.
Figure 2:
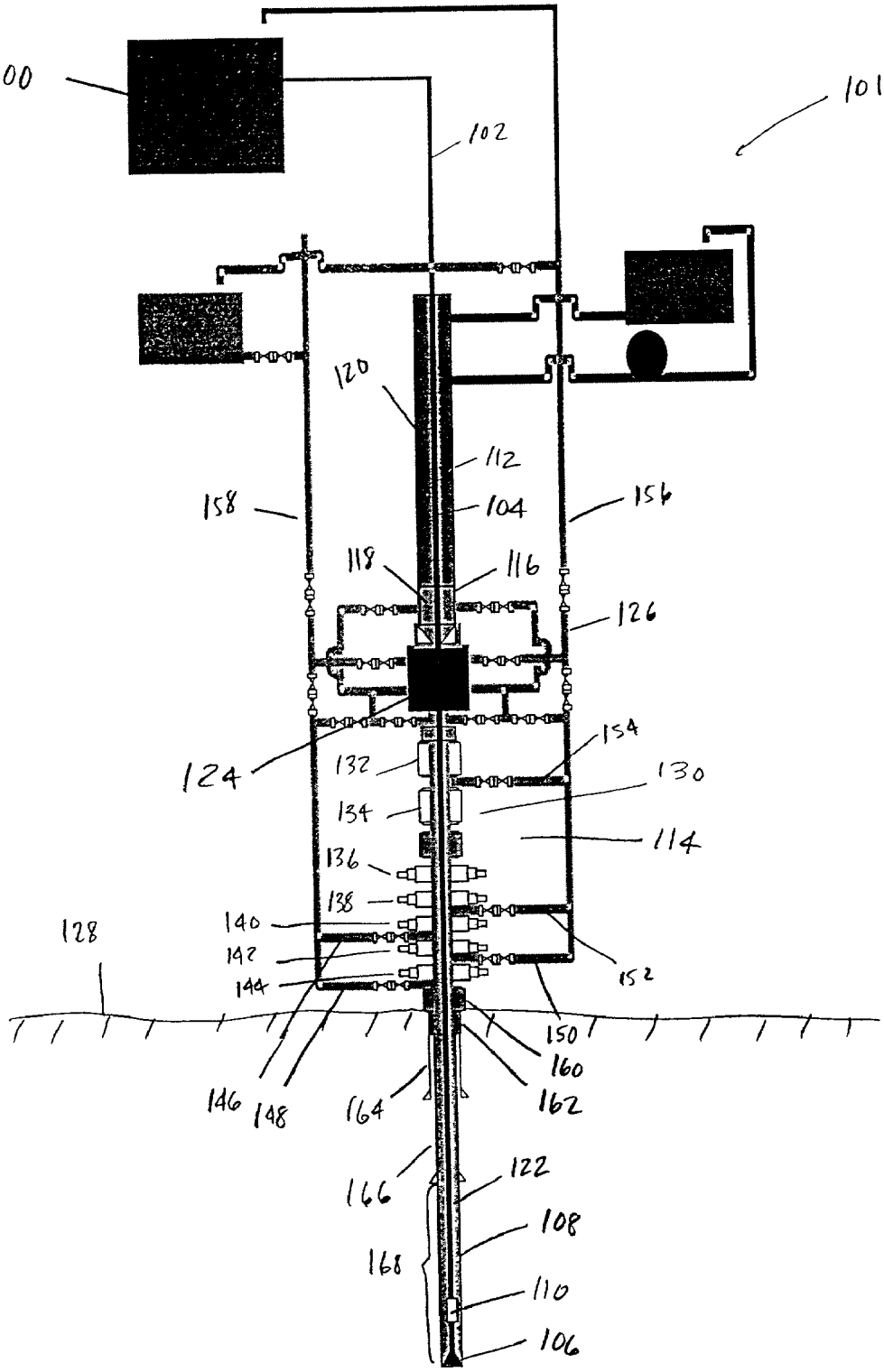
FIG. 2 shows an example of a subsea mudlift drilling system according to embodiments of the invention.

FIG. 2 shows an example of a typical subsea mudlift drilling (SMD) system 101 whose operation may be simulated in various embodiments of the invention. The SMD system 101 presented in the example is provided for illustration of the methods used in the present invention and is not intended to limit the scope of the invention. The methods of the invention may function in arrangements that differ from the SMD system 101 shown in FIG. 2.

The SMD system 101 has a surface drilling mud circulation system 100 that includes a drilling mud storage tank (not shown separately) and surface mud pumps (not shown separately). The surface drilling mud circulation system 100 and other surface components of the SMD system 101 are located on a drilling platform (not shown) or a floating drilling vessel (not shown). The surface drilling mud circulation system 100 pumps drilling mud through a surface pipe 102 into a drill string 104. The drill string 104 may include drill pipe (not shown), drill collars (not shown), a bottom hole assembly (not shown), and a drill bit 106 and extends from the surface to the bottom of a well 108. The drill string 104 may also include a drill string valve 110.

The SMD system 101 may include a marine riser 112 that extends from the surface to a subsea wellhead assembly 114. The marine riser 112 forms an annular chamber 120 that is typically filled with seawater. A lower end of the marine riser 112 may be connected to a subsea accumulator chamber ("SAC") 116. The SAC 116 may be connected to a subsea rotating diverter (SRD) 118. The SRD 118 functions to rotatably and sealingly engage the drill string 104 and separates drilling mud in a wellbore annulus 122 from seawater in an annular chamber 120 of the marine riser 112.

A discharge port of the SRD 118 may be connected to an inlet of a subsea mudlift pump ("MLP") 124. An outlet of the MLP 124 is connected to a mud return line 126 that returns drilling mud from the wellbore annulus 122 to the surface drilling mud circulation system 100. The MLP 124 typically operates in an automatic rate control mode so that an inlet pressure of the MLP 124 is maintained at a constant level. Typically, the MLP 124 inlet pressure is maintained at a level equal to the seawater hydrostatic pressure at the depth of the MLP 124 inlet plus a differential pressure that may be, for example, 50 psi. However, the MLP 124 pumping rate may be adjusted so that back pressure may be generated in the wellbore annulus 122. The MLP 124 may be a centrifugal pump, a triplex pump, or any other type of pump known in the art that may function to pump drilling mud from the seafloor 128 to the surface. Moreover, the MLP 124 may be powered by any means known in the art. For example, the MLP 124 may be powered by a seawater powered turbine or by seawater pumped under pressure from an auxiliary pump.

The inlet of the MLP 124 may be connected to a top of a blowout preventer stack 130. The BOP stack 130 may be of any design known in the art and may contain several different types of BOP. As an example, the BOP stack 130 shown in FIG. 2 includes an upper annular BOP 132, a lower annular BOP 134, an upper casing shear ram preventer 136, a shear ram preventer 138, and upper, middle, and lower pipe ram preventers 140, 142, and 144. The BOP stack 130 may have a different number of preventers if desired, and the number, type, size, and arrangement of the blowout preventers is not intended to limit the scope of the invention.

The BOP stack 130 also includes isolation lines such as lines 146, 148, 150, 152, and 154 that permit drilling mud to be circulated through choke/kill lines 156 and 158 after any of the BOPs have been closed. The isolation lines (146, 148, 150, 152, and 154) and choke/kill lines (156 and 158) may be selectively opened or closed. The isolation lines (146, 148, 150, 152, and 154) and the choke/kill lines (156 and 158) are important to the function of the invention because drilling mud must be able to flow in a controlled manner from the surface, through the well, and back after the BOPs are closed.

A lower end of the BOP stack 130 may be connected to a wellhead connector 160 that may be attached to a wellhead housing 162 positioned near the seafloor 128. The wellhead housing 162 is typically connected to conductor pipe (also referred to as conductor casing) 164 that is cemented in place in the well 108 near the seafloor 128. Additional casing strings, such as casing string 166, may be cemented in the well 108 below the conductor pipe 164. Furthermore, additional casing and liners may be used in the well 108 as required.

When drilling a wellbore 168, kicks may be encountered when formation fluid pressure is greater than a hydrostatic pressure in the wellbore 168. When a kick is detected, the aforementioned dynamic shut-in process is initiated and completed so that a kick intensity may be determined. The kick intensity may be defined as, for example, a volume of formation fluid that enters the wellbore 168 or as an excess of formation fluid (or "pore") pressure above a fluid pressure in the wellbore 168. However, the determination of the kick intensity may be complicated by the presence of a DSV 110 in the drill string 104. For example, a spring in the DSV 110 must be adjusted correctly so that it will activate the flow cone and block the flow ports when pump pressure is removed from the mud column in the drill string 104 such as by stopping the pumps. If the flow ports remain at least partially open, the well will continue to flow after the pumps have been shut down and the well 108 has been fully shut-in (note that flow from the formation may have stopped, but the leaking DSV may make it appear that the formation is still kicking). The DSV 110 may develop leaks from flow erosion or corrosion, among other causes. Therefore, it may be difficult to determine if flow in the well experienced after the pumps are shut down and the well is fully shut-in is due to a leaking or partially open DSV 110, or is due to additional influx that has entered the well 108. Continued flow may also make it difficult or impossible to calculate the volume of the kick or the drilling mud density required to effectively counteract the elevated formation pressure. Therefore, knowledge of whether the DSV 110 is leaking is important to well control procedures taken after the well 108 is fully shut-in.

While circulating and drilling, a hydrostatic pressure exerted by the drilling mud in the annulus 122, in addition to an annular friction pressure ("AFP") generated by the surface pump and an inlet pressure maintained by the MLP 124, contribute to a bottom hole pressure ("BHP") that opposes formation pore pressures encountered near a bottom of the well 108. The AFP is a pressure loss experienced (when the surface pumps are running) because of the friction between the drilling mud and annular surfaces (outer walls of the drill string 104 and inner walls of the well 108). Different drilling environments involve both overbalanced and underbalanced drilling operations, but kicks in both situations result from formation pore pressures that are higher than the BHP exerted by the fluid column. As previously, described, the MLP 124 inlet pressure is maintained at a level substantially equal to the seawater hydrostatic pressure ("SWH") at the depth of the MLP 124 inlet plus a selected differential pressure that may be, for example, a nominal amount such as 50 psi. Simultaneously, the MLP 124 maintains an outlet pressure sufficient to pump drilling mud from the seafloor 128 to the surface. A drill pipe pressure ("DPP") is maintained by the surface drilling mud pumps to circulate drilling mud through the drill string 104, through the drill bit 106, and into the wellbore annulus 122. The MLP 124 inlet pressure may be electronically monitored from the surface through a gauge (not shown) located in or near the inlet of the subsea MLP 124.

Background of the SMD Simulator

In some embodiments of the invention, a two-phase model (e.g., wherein one phase is a liquid such as drilling fluid and the other phase is a gas, such as a formation fluid influx or kick) is used in a well control program comprising a system for simulating kick behavior during well control procedures. The two-phase flow model was developed based on a realistic assumption of unsteady state two-phase mixture flow of a kick. The model comprises finite difference equations to increase simulation accuracy, and typical problems such as divergence of numerical solutions, negative drilling fluid velocity, oscillation of kick pressures in the wellbore, and numerical dissipation are compensated for using numerical techniques. The model will be described in detail below.

The simulation comprises a user-interactive well control simulator with enhanced graphics so as to simulate well control concepts and procedures. The simulation analyzes pressure and volume behaviors of the kick so as to, for example, determine a required surface choke pressure to maintain a specified bottom hole pressure (BHP) so that the kick may be controlled and eliminated from drilling mud circulation system.

Important aspects of the invention include kick volume in the wellbore and kick rise velocity. It has been determined from experimentation that solutions may be calculated if, for example, kick heights in the wellbore and kick rise velocities may be matched during computational analysis. The simulation includes the following aspects:

- Simulates the two-phase mixture as a combination of several single gas-mud mixtures layers;
- Each mixture has an effective gas volume fraction;
- The kick in each mixture can expand but can not move into adjacent mixtures;
- Mud in each mixture cannot generally move into other mixtures, but can move when the gas volume fraction is higher than a pre-specified maximum gas fraction, which in some embodiments is 0.85;
- Gas rise velocity at the very top of the mixture layers is calculated by the gas fraction of the top layer.
- Gas locations (or velocities) (other than the top mixture) are determined from mixture volumes;
- Simulates the performance of water-based drilling fluids;
- Considers the Driller's Method and the engineer's method of killing a well;
- Considers fluid properties and types;
- Considers mud temperature variations and gas compressibility factors;
- Considers four types of surface connections;
- Considers formation properties;
- Considers vertical wells and may be adapted to consider directional wells;
- Simulates drilling, taking a kick, and well confinement;
- Considers both manual and automatic control of wellbore kicks;
- Includes a graphical display of the intermediate results during well control procedures;
- Includes an animation of a well blowout; and
- Displays results in both graphical and digital forms.

The simulation software may be used, for example, as a hydraulic analysis tool for analyzing flow behavior in SMD operations and as a well control training tool for riserless drilling applications. Moreover, the simulation software may also be adapted to be coupled with a real-time well control panel so that the simulation software may be used as a basis for decision making in real-time well control procedures.

Well Control Methods Used With the SMD Simulator

Well control methods that may be used with the SMD simulator include, as described herein, the Driller's Method and the engineer's method. Preferably, the well control methods include the dynamic well control methods described in U.S. patent application Ser. No. 09/731,294 entitled "Controlling a Well in a Subsea Mudlift Drilling System," filed on Dec. 6, 2000, and assigned to the assignee of the present invention.

I. Two-Phase Flow Model Used in the Subsea Mudlift Drilling Simulation

In the SMD well control simulator, an important aspect of the SMD model is a two-phase gas kick simulation. Generally, it is difficult to simulate a kick as a true two-phase mixture while including an assumption of unsteady state flow. Accordingly, time and grid spacing in the simulation has to be selected carefully in order to achieve a numerically converged solution.

A two-phase flow model was developed in J. Choe and H. C. Juvkam-Wold, "*A Modified Two-Phase Well-Control Model and Its Computer Applications as a Training and Educational Tool,*" *SPE Computer Applications*, Vol. 9, No. 1, p.14–20 (1997) [hereinafter the "Choe model"]. The Choe model generally produces better results than many single-phase and two-phase models known in the art.

Figure 3:
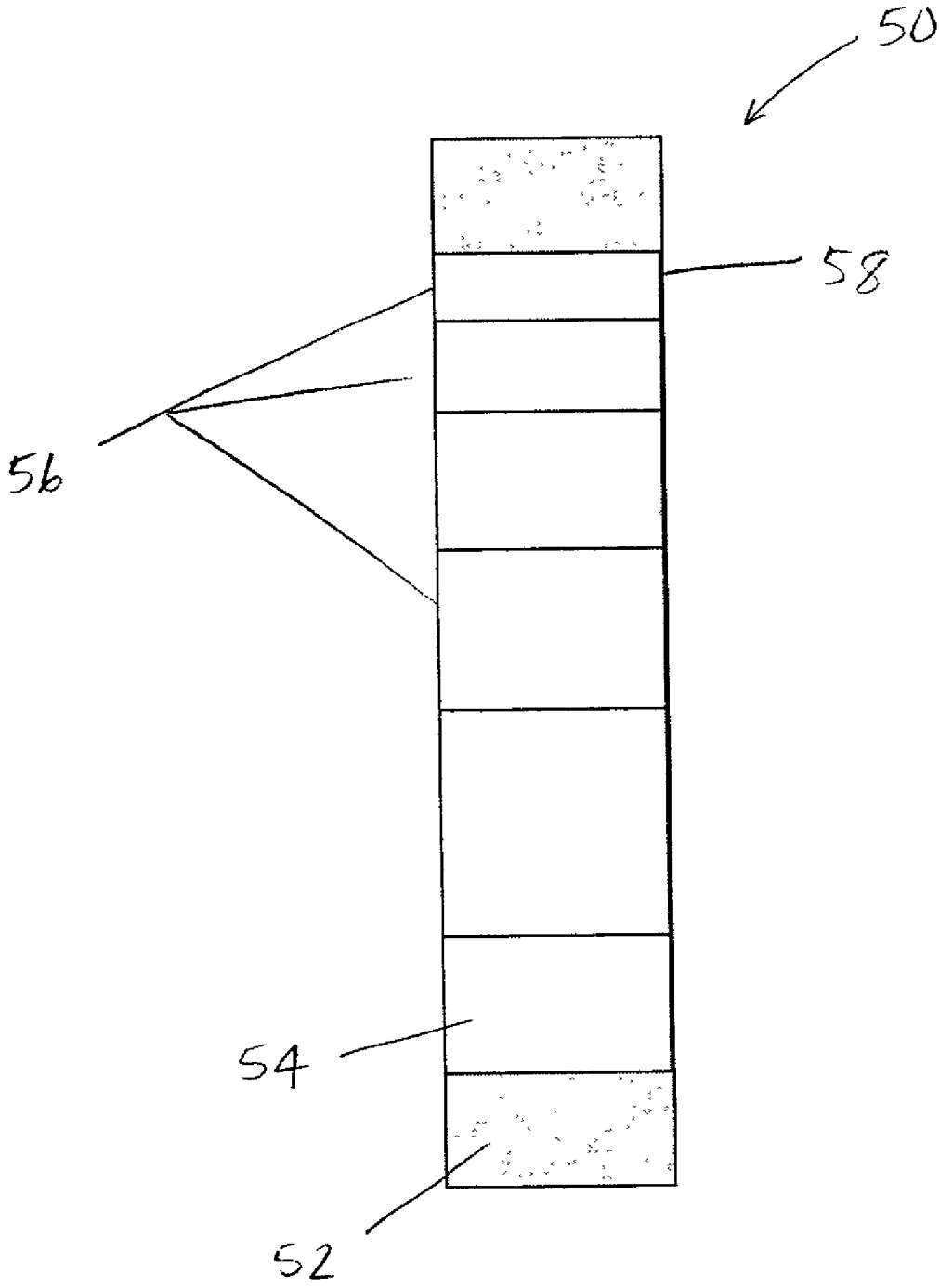
FIG. 3 shows aspects of a two-phase flow model according to an embodiment of the invention.

FIG. 3 shows some aspects of the Choe two-phase flow model. A two-phase mixture 50 of drilling fluid (mud) 52 and a formation fluid (typically a gas kick 54) is modeled as a combination of several single gas mud mixture layers 56. Each layer 56 comprises an effective gas fraction (e.g., a fraction of the layer 56 that comprises the gas kick). The gas fraction in each layer 56 can expand but cannot generally move in to adjacent layers (e.g., mass is typically conserved between layers). Moreover, the drilling mud 52 in each layer 56 generally cannot move into an adjacent layer unless the gas fraction (of the layer from which the mud is moving) is greater than a selected amount. For example, in some embodiments drilling mud cannot move into an adjacent layer unless the gas fraction is greater than approximately 85%. In some embodiments, a maximum gas fraction of a top layer is 45%. If a gas fraction of the top layer exceeds 45%, gas slip will occur between the top layer and an adjacent layer below the top layer so as to maintain the maximum gas fraction in the top layer.

A gas rise velocity may be calculated to determine a velocity at which the kick is rising in, for example, a mud return line. The gas rise velocity is calculated from the effective gas fraction in a top layer 58 in the mixture 50. Note that mixture velocities other than that of the top layer are typically estimated using the total volume of the mixture. In some embodiments, a record of kick influx volume and mud circulation volume for a given time duration may be recorded and evaluated to ensure conservation of mass in each mixture layer during the SMD simulation.

The Choe model may also be adapted to simulate, for example, oil-based drilling fluids, synthetic drilling fluids, mineral oil-based drilling fluids, and the like. Moreover, the Choe model may be adapted to account for:

- Non-constant drilling fluid viscosity (e.g., mud viscosity as a function of pressure and temperature);
- Compressible drilling fluids and multiple fluid densities in the wellbore (e.g., the model may be adapted to compensate for viscosity changes in deep water wells and at low temperatures);
- Mud temperature measurements taken directly from MWD tools, LWD tools, or emplaced sensors in the wellbore;
- Directional and horizontal wells (e.g., so that both measured depth and true vertical depth may be determined); and
- Land wells (as opposed to SMD operation).

The Choe model uses modifications of known equations to simulate two-phase flow and to calculate, for example, frictional pressure losses (FPL) in the SMD circulation system. Three Theological models are known in the art and are commonly used to approximate drilling fluid hydraulics. The models include the Newtonian model, the Bingham plastic model, and the Power-law model. These models are described in detail in, for example, Bourgoyne, Millheim, Chenevert, & Young, *Applied Drilling Engineering*, SPE Textbook Series, Volume 2 (1991).

All three models are incorporated into the Choe model and may be selected via a graphical user interface, as shown in FIG. 4. The Choe model uses an equation described in Bourgoyne et al. to determine FPL for each of the three models:

$$\frac{\Delta p_f}{\Delta L} = f\frac{\rho v^2}{25.8 d_e} \tag{1}$$

where $\Delta p_f/\Delta L$ is the FPL (a change in frictional pressure "$p_f$" over a selected length "L" of the circulation system), f is a friction factor, ρ is a fluid density (in ppg), v is a fluid velocity (in ft/sec), and $d_e$ is an effective diameter of a flow path (in inches). For circular pipe, $d_e$ is analogous to an inner diameter, while for annular flow the $d_e$ is calculated as:

$$d_e = 0.816(d_o - d_i) \tag{2}$$

where $d_o$ is an outer diameter of the annulus (e.g., the wellbore diameter), and $d_i$ is an inner diameter (e.g., an outer diameter of drillpipe that forms an inner diameter of the annulus).

The friction factor "f" may be calculated for both laminar and turbulent flows using equations that are known in the art. For example, Fanning's equation may be used to determine the friction factor for laminar flow regimes while different equations are required for the different flow models (e.g., Newtonian, Bingham plastic, and Power-law) in turbulent regimes. For example, the Colebrook equation may be used to determine an empirical friction factor for the Bingham plastic model while the Dodge and Metzner equation may be used in a similar manner for the Power-law model. As required, effective viscosities and the like that are required for the calculation of turbulent friction factors may be determined according to the methods described in Bourgoyne et al.

In some embodiments, drilling fluid properties (such as density, viscosity, Bingham yield point, and Power-law properties) are assumed to be constant for the entire pressure and temperature ranges experienced in the wellbore. It is contemplated, however, that other embodiments may be adapted to compensate for synthetic or oil-based drilling fluids in which the aforementioned properties, among other properties, are not constant at, for example, low temperatures experienced in deepwater SMD.

In other embodiments, drilling fluid properties, except for density, are calculated using two representative viscometer readings at 600 rpm and 300 rpm. However, other embodiments may be adapted to include viscometer readings at, for example, 3, 6, and 100 rpm so as to simulate low shear strain rates. Further, because the Dodge and Metzner friction factor equation is valid only for smooth circular conduits, friction pressure loss (FPL) calculated using the Power-law and Newtonian models are only valid for smooth circular conduits. As a result, pipe roughness is not considered for the two models and, as a result, a user input box for pipe roughness is disabled when the Newtonian or Power-law models are selected. Note that, however, the Bingham plastic model is adapted to compensate for pipe roughness so that, for example, comparative models and simulations may be developed and analyzed.

The Choe model also calculates pressure loss through drill bit nozzles based on assumptions outlined in Bourgoyne et al. including: (1) pressure changes due to elevation are insignificant; (2) a drilling fluid flow velocity upstream of the nozzles is insignificant compared to the flow velocity proximate the nozzles; and (3) viscous friction effects proximate the nozzles are insignificant. The following equation is used in some embodiments of the Choe model:

$$\Delta p_{bit} = \frac{8.311 \times 10^{-5} \rho q^2}{C_d^2 A} \tag{3}$$

where $C_d$ is a discharge coefficient (assumed to be 0.95 in most embodiments of the invention), A is a total bit nozzle area (in $in^2$), ρ is a drilling fluid density, and q is a drilling fluid flow rate (in gpm).

Determination of Formation Pore and Fracture Pressures

Determination of pore and fracture pressures is an important aspect of the Choe model and of any well planning and control operation. The Choe model incorporates three methods for determining formation pore and fracture pressures as a function of depth, and the user may select the method used in the simulation via the graphical user interface. The three methods include user input values and gradients (as determined, for example, from actual well data or from leak-off tests), the method developed by Barker and Wood in "*Estimating Shallow Below Mudline Deepwater Gulf of Mexico Fracture Gradients*," Proceedings of the AADE Houston Chapter Annual Technical Meeting (1997), and the method developed by Eaton in "*Fracture Gradient Prediction and Its Applications in Oilfield Operations*," Journal of Petroleum Technology, p.1353–1360 (1969) and "*Fracture Gradient Prediction for the New Generation*," World Oil, p. 93–100 (October 1997).

Water and Drilling Fluid Temperature Gradients

Water and drilling fluid temperature gradients are generally required to calculate temperature at depths of interest in the wellbore. Temperature information is used for gas kick simulation but not for drilling fluid properties such as: kick expansion, gas expansion factor, kick density, kick-mud surface tension, and the like. Temperature distributions in the drilling fluid return line are determined from a sea water temperature gradient. However, a minimum temperature (in the return line) imposed on the simulation is 32° F. Temperature distributions below the mud line (BML) are computed using a geothermal gradient, defined as a "mud temperature gradient" in the input box in the graphical user interface.

This method of determining water and drilling fluid temperature gradients is relatively simple computationally, but the assumption is made that mud and kick temperatures are the same as the surrounding temperature (e.g., proximate the formation or the seawater surrounding the return line). Accordingly, it is contemplated within the scope of the invention to adapt the simulation to compensate for nonlinear temperature gradients that are determined from models or, for example, from curve fits applied to measured downhole data. Further, it is expressly within the scope of the invention to adapt the Choe method to account for heat transfer between the drilling fluid and the formation, the drilling fluid and seawater, and the like.

Calculation of Gas Kick Properties

Calculation of gas kick properties is another important aspect of kick simulation because, for example, they are functions of the pressure and temperature and generally control kick behavior. Typical properties comprise a gas compressibility factor, gas density, gas viscosity, and mud-gas surface tension. Incorrect calculation of gas kick properties will result in incorrect simulation of the two-phase mixture flow. The Choe model uses a model developed by Sutton in "*Compressibility Factors for High-Molecular-Weight Reservoir Gases*," Proceedings of the SPE 14265, 60th SPE Annual Technical Conference and Exhibition, Las Vegas, Nev. (1985) to model gas kick properties.

The Sutton model is useful because, in many cases, detailed components of the gas kick are unknown. Therefore, the equations developed by Sutton are generally in terms of pressure, temperature, and gas specific gravity so that difficult to measure downhole parameters are not required for the calculations. These so called "pseudo-reduced properties" are defined relative to a pseudo-critical pressure and a pseudo-critical temperature.

A gas compressibility factor (often referred to as a "z-factor") is determined (in the Choe model) according to a method developed by Dranchuk and Abou-Kassem in "*Calculation of Z Factors for Natural Gases using Equation of State*," JCPT, p.34–36 (July 1975). The Dranchuk and Abou-Kassem model is non-linear and may be solved by, for example, Newtonian iteration or other iterative methods known in the art. This model is valid in extended pressure and temperature regions.

Note that the presence of carbon dioxide ($CO_2$) and hydrogen sulfide ($H_2S$) affect the value of the z-factor obtained from the Dranchuk and Abou-Kassem model. Accordingly, to correct for impurities (including $CO_2$ and $H_2S$ content), the method developed by Wichert and Aziz, available in Brill and Beggs, "*Two-Phase Flow in Pipes*," University of Tulsa Press (1984) is used to adjust the pseudo-critical values used in and determined by the Dranchuk and Abou-Kassem model.

Gas kick density can generally be derived from the equation of state. The following equation is used in the Choe model:

$$\rho_g = 0.3611 \frac{\gamma_g p}{zT}. \tag{4}$$

where $\rho_g$ is gas kick density, p is pressure (in psia), T is temperature (in ° R), z is the above determined gas compressibility factor, and $\gamma_g$ is the above determined gas specific gravity.

Gas kick viscosity is determined according to the method developed by Lee and Gonzalez in "*The Viscosity of Natural Gas*," Journal of Petroleum Technology, p.997–1000 (1966).

Gas-mud surface tension is an important aspect of kick simulation in that it helps determine and predict gas migration, gas slip velocity (relative to the mud), and the like. Moreover, gas-mud surface tension also helps determine a location of a top of the kick in the wellbore, a mud return line, and the like. The Choe model uses linear interpolation of tabular data to calculate the gas-mud surface tension in the gas-kick system.

A table such as that shown in FIG. 5 is used to determine gas-mud surface tension. For example, surface tension is typically determined at selected values that generally cover an expected range of SMD operations (e.g., between 74° F. and 280° F. as shown in FIG. 5). As shown in the Figure, linear interpolation is used to fill out the Table at selected temperatures, and the Choe model may be easily programmed to further estimate a plurality of gas-mud surface tensions at a plurality of corresponding temperatures.

Note that the highest pressure used in this embodiment of the Choe model is 9000 psia. SMD drilling operations will almost certainly experience higher pressures in deep wells. When pressures and/or temperatures that are out of the range of the Table are experienced in SMD drilling, some embodiments use the boundary values defined in the Table so as to avoid extrapolation errors. If detailed measurements are available from an existing well, the Choe model may be adapted to incorporate those values.

Two-Phase Friction Pressure Loss Calculation in the Gas-Mud Mixture Region

Friction Pressure Loss (FPL) calculations are also required in the gas kick/drilling mud mixture region. Generally, previous methods have incorporated a "no-slip" condition for two-phase flow analysis and modeling. "No-slip" effectively means that the liquid and gas components of the mixture flow at the same velocity. The Choe model provides for a "no-slip" condition within the gas-mud mixture (e.g., in a "micro" analysis), but, as will be discussed later, models gas-slip of a kick in the wellbore and return line (e.g., as a "macro" analysis).

Essentially, FPL calculations within the gas-mud mixture are similar to the model described in Equation (1). For example, the following equation can be used to calculate two-phase FPL in the mixture layer.

$$\frac{\Delta p_f}{\Delta L} = f_{tp}\frac{\rho_n v_n^2}{25.5 d_e} \tag{5}$$

where $f_{tp}$ is a two-phase friction factor, $\rho_n$ is a "no-slip" flow density, $v_n$ is a no-slip flow velocity, and $d_e$ is determined from Equation (2). Moreover, a two-phase "no-slip" Reynolds Number for the calculations may be determined as:

$$N_{Re,n} = \frac{928\rho_n v_n d_e}{\mu_n} \tag{6}$$

where $\mu_n$ is a no-slip effective viscosity determined in a manner as described below. The no-slip flow density and no slip effective viscosity may be determined by Equations (7) and (8):

$$\rho_n = \rho_l\lambda_l + \rho_g\lambda_g \tag{7}$$

$$\mu_n = \mu_l\lambda_l + \mu_g\lambda_g \tag{8}$$

where $\rho$ and $\mu$ are as described above, $\lambda$ is a "no-slip" holdup, and the subscripts "l" and "g" represent liquid and gas components of the mixture, respectively. The no-slip velocity may be calculated by Equation (9):

$$v_n = \frac{q_1 + q_g}{3.117A} \tag{9}$$

where $q_l$ and $q_g$ are liquid and gas flow rates (gpm), respectively, and A is a total flow area ($in^2$).

The two-phase friction factor ($f_{tp}$) may be determined from methods defined in Beggs and Brill in "*A Study of Two-Phase Flow in Inclined Pipes*," Journal of Petroleum Technology, p.607–617 (1973). The Beggs and Brill methods were developed from experimental data and cover a wide range of inclination angles (e.g., from horizontal flow to vertical flow). The two-phase friction factor is dependent on liquid holdup, which has different values for different flow regimes and inclination angles (as measured from horizontal). Note that, although Beggs and Brill provide a detailed equation to compute liquid holdup, the Choe model uses an effective gas fraction in the two-phase region as the true value.

II. Subroutines Used for Simulating Subsea Mudlift Drilling and Well Control Operations The following description shows how the numerical methods described above are incorporated into subroutines that are used to simulate SMD operations using the Choe model. The following calculations and determinations are a part of an interactive simulation that enables users to observe and control drilling operations and kicks. User interaction and use of the simulation as both a training mechanism and real-time well control tool will be described in detail below in Part III.

Calculation of Fluid Height in the Wellbore and Return Line

Figure 6:
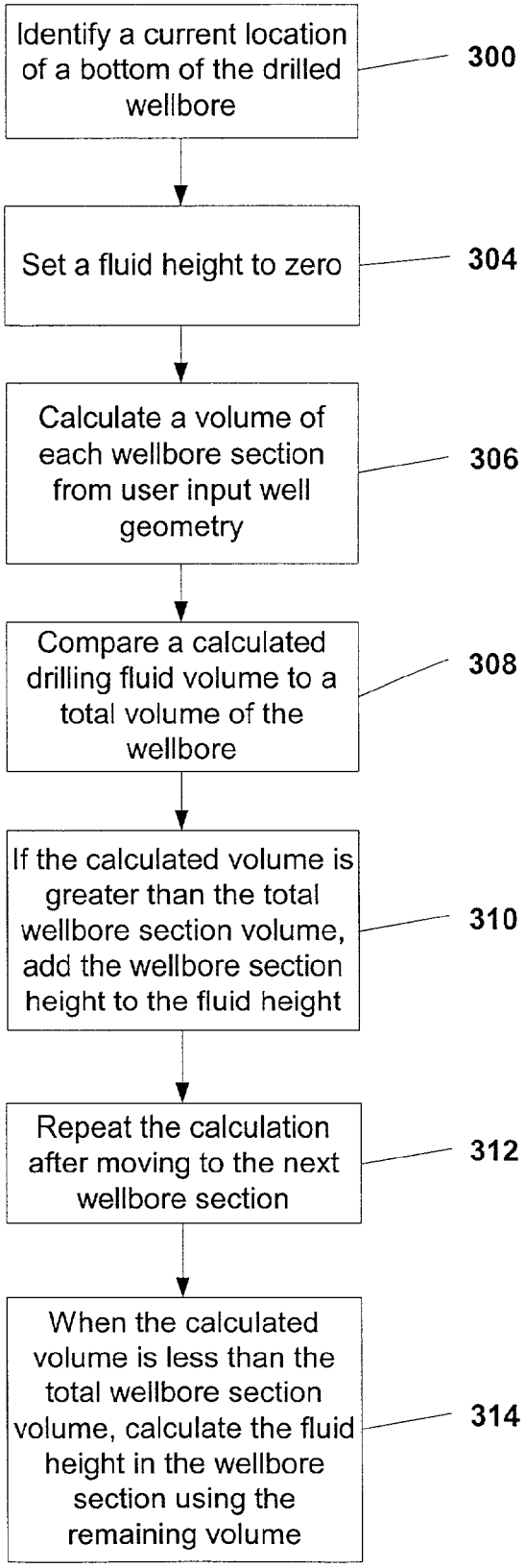
FIG. 6 shows some of the steps included in a wellbore fluid height calculation according to an embodiment of the invention.

In a first step of an embodiment of the simulation, a subroutine is used to determine a height of a given volume of fluid in the wellbore. This determination is necessary for calculating hydrostatic pressure in the wellbore and circulation system, calculating friction pressure losses, and tracking kicks (e.g., for tracking a top of the mud-fluid mixture layers). For a uniform well geometry, fluid height calculations are relatively simple. However, for variable wellbore geometry, the Choe model includes a generalized software routine for determining fluid height. FIG. 6 shows some of the step used to determine fluid height in some embodiments of the Choe model simulation:

- Identify a current location of a bottom of the drilled wellbore 300 and use the current location as an initial index.
- Starting from the initial index, set fluid height to zero 304.
- Calculate a volume of each wellbore section 306 from user input well geometry (wherein, for example, the user input data is received via a graphical user interface).
- Compare a calculated drilling fluid volume to a total wellbore section volume 308.
- If the calculated volume is greater than the total wellbore section volume, add the section height to the fluid height 310. Then repeat the calculation by moving to the next wellbore section 312.
- When the calculated volume is less than the total wellbore section volume, calculate the fluid height in the section using the remaining volume 314.

Calculation of FPL in Single-Phase and Two-Phase Region

Based on the detailed explanation provided above, a subroutine is adapted to calculate friction pressure losses (FPL) for single-phase and two-phase regions in the wellbore. Separate software subroutines are used to calculate FPL for single-phase and two-phase flows. However, the separate subroutines are used for convenience of programming, and other embodiments may include a single subroutine adapted to calculate FPL for both flow regimes.

For a single-phase flow regime, FPL may be determined at a selected location in the wellbore by specifying flow rate, pipe outer diameter (OD) and inner diameter (ID), and drilling fluid density as user inputs via the graphical user interface. Other global variables (that are either simulation defaults or user inputs) are used as well. For example, for pipe flow, the Choe model simulation sets the ID to zero and a subroutine calculates FPL for the three different fluid models described above (e.g., the Newtonian model, the Bingham plastic model, and the Power-law model). Another subroutine calculates the friction factor for each of the three models.

For a two-phase flow regime, FPL may be determined for a selected location in the wellbore by specifying flow rate, pipe outer diameter (OD) and inner diameter (ID), and drilling fluid density as user inputs via the graphical user interface. Moreover, a gas velocity, a drilling fluid fraction (e.g., the drilling fluid fraction may be determined after a kick volume is estimated by subtracting the estimated kick volume from a total circulating volume), an estimated gas density, and an estimated gas viscosity are also required, and these values may also be user inputs, simulation defaults, and the like.

Note that it is also within the scope of the invention to directly input actual well data (either manually or automatically) into the various subroutines. For example, mud pit gain may be used to estimate the kick volume and drilling fluid fraction, and downhole sensors may be able to determine characteristics such as gas density, etc. Accordingly, both real-time data and recorded data (e.g., from previously drilled wells) may be incorporated into the simulation.

Figure 7:
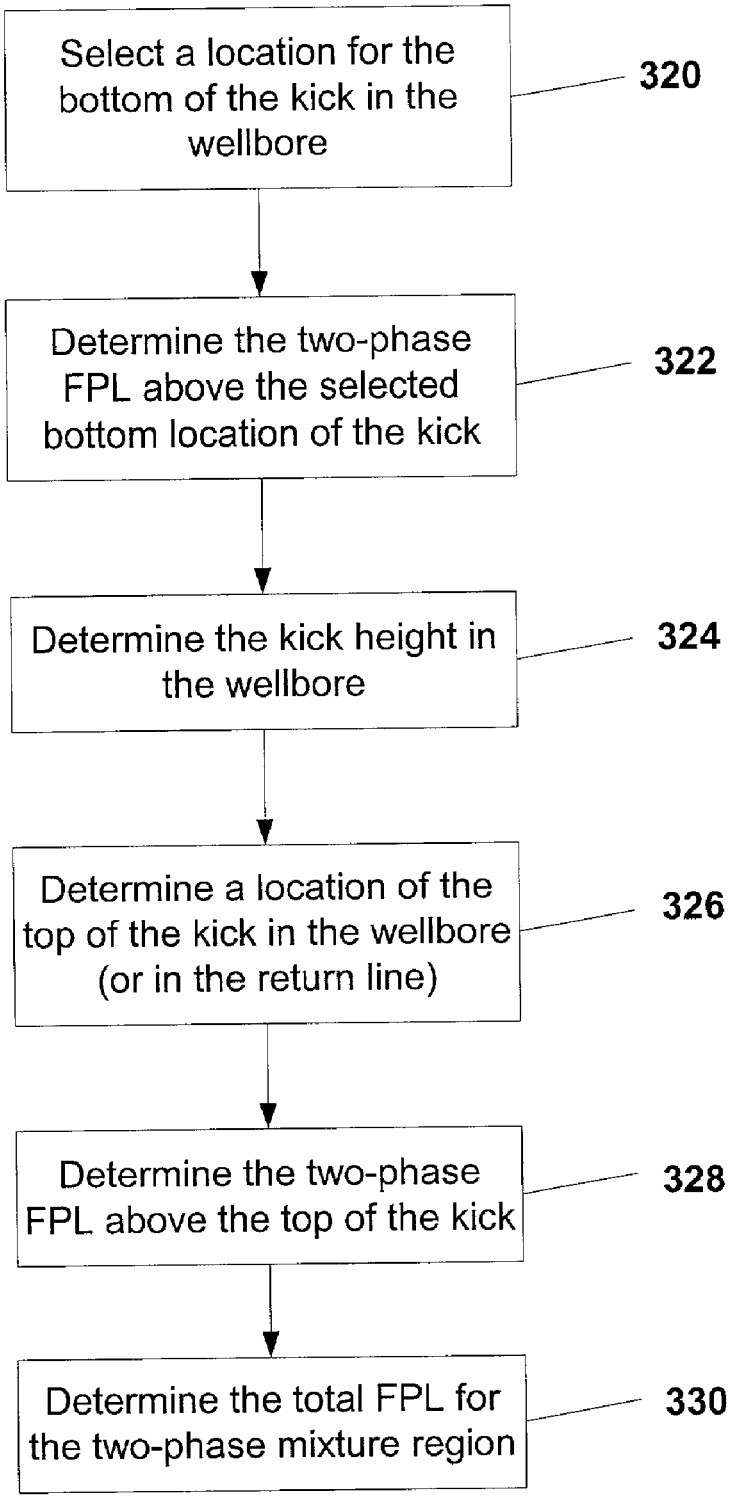
FIG. 7 shows an example of a procedure used to determine a location of a top of a kick according to an embodiment of the invention.

Another subroutine is adapted to calculate a total FPL above and below a selected location in the wellbore (for the given flow rate and density) for both single-phase and two-phase flow regimes. This subroutine, when used in combination with the fluid height determination subroutine, may be used to calculate two-phase friction pressure loss of the two-phase mixture in the wellbore. FIG. 7 shows an example of this determination according to one embodiment of the invention:

- Select a location for the bottom of the kick in the wellbore 320 (e.g., this location may generally be the location of the formation from which the kick originates). This location represents the bottom of the two-phase gas-mud mixture.
- Determine the two-phase FPL above the selected location of the bottom of the kick 322.
- Determine the kick height in the wellbore 324.
- Determine a location of the top of the kick in the wellbore 326 or, e.g., in a mud return line.
- Determine the two-phase FPL above the top of the kick 328.
- Determine the total FPL for the two-phase mixture region 330 from the difference in the FPL proximate the bottom of the kick and the FPL above the top of the kick.

Calculation of Pressure Drop Across A Drill String Valve (DSV)

As described above in the discussion of SMD, a drillstring valve (DSV) comprises an important aspect of an SMD system (although the DSV is not required in all SMD operations). For example, the DSV may help prevent U-tubing and, therefore, it may help prevent late kick detection by keeping the well from flowing after surface pump shutdown. From a purely hydraulic point of view, the DSV may be modeled as a choke that causes additional pressures losses in the circulation system. The simulation models the DSV using input data of flow rate vs. differential pressure for a designated mud weight and, as a result, the DSV characteristic data should be accurate for the designated mud weight.

However, in many cases, the mud in the wellbore may be different from the designated mud weight. For example, heavy kill weight mud may have to be circulated to kill the well. When this occurs, the DSV characteristics will change. The same is true when the mud in the wellbore is relatively lighter than the designated mud weight. In order to simulate these situations, the Choe model uses a simple approach to adjust differential pressure as a function of a mud weight ratio. The following equations are used in some embodiments of the Choe model:

$$\text{Mud Weight Ratio} = MR = \frac{\text{Mud Weight In Use}}{\text{Designated Mud Weight}} \tag{10}$$

$$\Delta P_{DSV,New} = \Delta P_{DSV,Designated} \cdot MR + 0.5 \cdot \Delta P_{DSV,Designated} \cdot \frac{1 - MR}{MR^2} \tag{11}$$

where $\Delta P_{DSV,New}$ is the DSV pressure drop caused by the new mud weight circulated in the wellbore and $\Delta P_{DSV,Designated}$ is the DSV pressure drop caused by the original or designated mud weight. Note that, as an alternative to this estimated mud weight ratio, an experimental database relating different mud weights and different DSV geometries to pressure drops may be developed and linked to the subroutines.

Determination of Equivalent ID for Multiple Return Lines

The subroutines that perform hydraulic analyses for drilling fluid return lines should preferably consider the use of multiple return lines, choke lines, and/or kill lines in the drilling fluid circulation system. When multiple return lines are used, an equivalent ID of the lines (in terms of frictional pressure loss) must be determined. The Choe model includes subroutines to perform these calculations.

For multiple main lines (return lines) having identical IDs, an equivalent flow rate in each line is simply determined by dividing the total flow rate by the number of lines. The same method is applied when only multiple secondary lines are used. Although there is no difference in the calculations, main lines may be distinguished from secondary lines because they comprise separate input boxes in the graphical user interface of some embodiments. For the multiple main and secondary return lines, iterative solutions may be used to determine flow rates in each line (assuming, for example, identical friction pressure losses (FPLs)). A bisection numerical technique is used in some embodiments, but other iterative methods known in the art may be used as well. The subroutines described above may be used for actual calculation of the FPLs. If a converged solution for the equivalent flow rate for the main return line is determined using the bisection numerical method, the corresponding determined FPLs may be used to calculate an equivalent ID for all of the return lines. For example, a bisection numerical method may be used to determine an equivalent ID that produces the same FPL for the total flow rate.

Calculation of Gas Slip Velocity

Another aspect of the Choe model includes a calculation of a bubble migration velocity, which helps determine kick behavior. A maximum back-pressure in the circulation system is generally observed when kick fluids reach the surface because of high expansion rates exhibited by gas kicks. A total time required for kick fluids to reach the surface from the bottom of the wellbore is strongly dependent on the bubble migration (e.g., also referred to as "slip") velocity. The bubble migration velocity is typically a function of flow rate, fluid properties, wellbore geometry, and the like.

Because two-phase flow phenomena are very complex, many attempts at modeling and predicting bubble migration velocities have been developed. For example, Harmathy, in "*Velocity of Large Drops and Bubbles in Media of Infinite or Restricted Extent*," AIChEJ, p. 282–289 (1960), proposed a single bubble rise velocity in an infinite medium. The Harmathy method is used in the Choe model, and a subroutine is adapted to calculate the bubble rise velocity from a gas-liquid surface tension, a liquid density, and a gas density.

Bubble rise velocity is also calculated in subroutines adapted to simulate well shut-in and kick circulation. The bubble rise velocity model is based on a correlation model developed by Hasan and Kabir in "*Predicting Multiphase Flow Behavior in a Deviated Well*," SPEPE, p.474–482 (1988), and in "*A Study of Multiphase Flow Behavior in Vertical Oil Wells: Part I—Theoretical Treatment*," Proceedings of the SPE 15138, 56$^{th}$ California Regional Meeting of SPE, Oakland, Calif. (April 1986). The models include experimental correlations of procedures performed to analyze two-phase flow in pipes and variable geometry annular flow arrangements. The models are based on Equation (12):

$$v_g = Cv_n + v_s \tag{12}$$

where $v_g$ is the bubble rise velocity, $v_n$ is a determined no-slip velocity, $v_s$ is a determined slip velocity, and "C" is a constant. Note that the Harmathy method is particularly good for determining gas slip velocities for bubble flow regimes where a gas volume fraction is less than about 0.25. Accordingly, the Hasan and Kabir model also uses the Harmathy method when a gas fraction is less than about 0.25.

In many cases, numerical solutions for unsteady state two-phase well control models do not converge because of, for example, distinct two-phase flow maps including bubble flow, slug flow, churn flow, and annular flow. Annular flow is one type of gas flow that usually occurs when there is a relatively high gas influx rate as compared to a liquid flow rate. In an annular flow regime, the liquid component of the flow (e.g., drilling fluid) forms a thin film on a surface of the pipe and a gas flow comprising small drops of liquid flows through a center portion of the pipe.

In order to compensate for the different flow regimes that are present in unsteady state two-phase flow, a gas fraction of the flow must be considered so as to obtain a converged solution. This method differs from the original Hasan and Kabir model, and the Choe model uses a method that considers:

Bubble flow if a gas fraction of the total flow is <0.25 (25%)

Slug flow if: 0.55<gas fraction <0.75

Annular flow if a gas fraction of the total flow is >0.90 (90%)

Based on above criteria, the Choe model is adapted to calculate the bubble migration velocity from the Hasan and Kabir model. Note that linear variations between different flow regimes are assumed in the gas fraction region between, for example, bubble flow and slug flow. Accordingly, a gas fraction of between approximately 0.25 and 0.55 produces a flow regime that is a combination of bubble flow and slug flow. Further, it has been determined that the Hasan and Kabir model generates high bubble migration velocities for deep well applications. Therefore, the Choe model compensates for this phenomena by assigning a "C" value of 1.0 for most SMD applications. Note that the Choe model may be adapted to assume that a well is inclined if a well angle is greater than 5 degrees from vertical and that there is no gas slip if the well angle is greater than 87 degrees (e.g., in a substantially horizontal well).

Analyses of U-Tubing and Kelly Cut

U-tubing is a common phenomenon experienced in SMD operations. The Choe model is adapted to determine a maximum mud free fall during connection (which will last typically 2 to 3 minutes) and to determine an amount of air trapped inside the drillstring during the connection (which is generally referred to as "Kelly Cut").

During normal drilling operations, an inlet pressure of a subsea mudlift pump (MLP) will typically be maintained at a constant level in order to maintain a selected bottom hole pressure (BHP) (and this mode of operations is generally referred to as a "Constant Pressure Mode"). More specifically, MLP inlet pressure will generally be maintained at a pressure equal to the gradient of the seawater plus an additional differential pressure (which may be, for example, 50 psi). When the surface pump is shut down so as to, for example, add section of drillpipe, a fluid level inside the drillpipe will drop until the hydrostatic pressure of the drilling fluid inside the drillpipe (above the seafloor) is approximately equal to the hydrostatic pressure of the surrounding seawater.

In order to determine a transient flow rate and a corresponding mud level inside the drillpipe, a dynamic equilibrium calculation is evaluated. A hydrostatic imbalance inside the drillpipe, which is a driving force of the U-tubing, will balance a system pressure loss and MLP inlet pressure. In other words, a flow rate is calculated that equates a friction pressure loss (FPL) to the hydrostatic imbalance inside the drillpipe. Because the Choe model uses a user-selected flow model (e.g., the Newtonian, Bingham Plastic, or Power-law method) to calculate pressure losses and because the flow rate due to U-tubing lies between surface mud circulation rate and zero, a bisection method is used to determine the U-tube flow rate and the corresponding mud level in the drillpipe.

A maximum mud height ($h_{max}$) in the drillpipe during U-tubing is a function of mud density $\rho_{mud}$, water depth ($D_w$), and MLP inlet pressure ($p_{inlet}$) The maximum height of mud in the drillpipe may be determined from Equation (13):

$$h_{\max} = D_w - \frac{p_{inlet}}{0.052\ \rho_{mud}}. \tag{13}$$

Kelly cut calculations are also relatively simple. The Choe model assumes that air specific gravity is 1.0 and that the air entrapped in the drillpipe obeys the real gas law. An air compressibility factor (z-factor) is calculated using a method developed by Dranchuk and Abou-Kassem in "*Calculation of Z Factors for Natural Gases using Equation of State,*" *JCPT*, p.34–36 (July 1975). Note that previous calculations have determined that Kelly cut effects are relatively minor in large volume systems (such as SMD systems).

Determining Gas Influx Rate from the Formation

A determination of gas influx rate from the formation into the wellbore may help determine, for example, gas holdup and pit volume gain. Gas flow in infinite homogeneous reservoirs can be modeled using an equation similar to that used to pseudo-pressure model flow of slightly compressible liquids described in John Lee, *Well Testing*, SPE (1982), p.76. Equations (14) and (15) may be used to determine the gas influx rate:

$$q_g = \frac{T_{sc}hk[m(p_{fm}) - m(p_{bh})]}{50300\ P_{sc}T\left[1.151\ \log\left(\frac{kt}{1688\phi\mu_i c_{ti} r_w^2}\right) + S\right]} \text{ and} \tag{14}$$

$$m(p) = 2\int_{p^0}^{p} \frac{p}{\mu z} dp \tag{15}$$

where, $q_g$ is a gas influx flow rate in Mscf/day, T is a downhole temperature in ° R, h is a penetrated depth (in ft), k is a formation permeability (in md), m(p) is a pseudo-pressure, $p^0$ is a reference pressure (in psia), p is a pressure of interest at a selected location in the wellbore (in psia), z is a gas compressibility factor, t is the time (in hours), μ is a gas viscosity (in cp), $r_w$ is a radius of an open hole region where the influx occurs (in ft), and S is a skin factor. Subscripts "sc" and "i" represent standard conditions (14.6 psia and 520° R) and initial conditions in the reservoir, respectively. The pseudo-pressure approach developed by Lee and modified for the Choe model is valid for SMD operating pressure ranges when calculating gas influx. Initial variables (e.g., initial conditions and the like) used in the equations may be accessed from a memory, entered by the user, or determined from real-time data.

At each time step of the simulation, the Choe model maintains a record of time and open hole depth of penetration. Because the gas influx rate is measured at standard conditions, it must be converted to bottom hole conditions in order to accurately determine pit volume gain and a two-phase correlation. The conversion is completed by multiplying the "standard" influx rate by a gas formation volume factor that is a ratio of a gas volume at reservoir conditions to a gas volume at standard conditions. The gas formation volume factor may be determined using Equation (16):

$$B_g = 0.00504\frac{zT}{p} \tag{16}$$

where $B_g$ is the gas formation volume factor (in rbbls/scf), z is the gas compressibility factor, T is a downhole temperature, and p is a downhole pressure. Note that gas influx rate is calculated assuming that gas influx at one formation interval is independent of other formations penetrated. Moreover, a total influx at any time is a summation of gas flow for each penetrated formation. Finally, effects of formation damage, partial penetration, and non-Darcy flow are taken into account by the effective total skin factor (S in Equation (14)).

Kick Simulation

The kick simulation subroutine considers the following factors (among other factors):

- Surface pump rate;
- Kick influx volume and rate;
- Two-phase flow (of circulating mud and the gas kick);
- U-tubing (if applicable);
- MLP operation mode (constant pressure mode versus constant flow rate mode); and
- Wellbore pressure buildup.

Further, although mud density is generally assumed constant (e.g., the mud is considered to be incompressible) for well circulation calculations, variations in mud density are considered for well control because the amount of pressure build-up in the well is determined by assuming that both the mud and gas kick are compressible:

$$\Delta p = \frac{\Delta V_{kick} + \Delta V_{mud}}{(C_{kick}V_{kivk} + C_{mud}V_{mud})} \text{ where} \tag{17}$$

$$C_{kick} = \frac{1}{p} - \frac{1}{z}\frac{dz}{dp}. \tag{18}$$

In Equation (17), $\Delta V_{kick}$ and $\Delta V_{mud}$ are gas and mud volume changes, $V_{kick}$ and $V_{mud}$ are gas and mud volumes, and $C_{kick}$ and $C_{mud}$ are gas and mud compressibility factors, respectively. Note that z in Equation (18) is the gas compressibility factor discussed previously.

Figure 8:
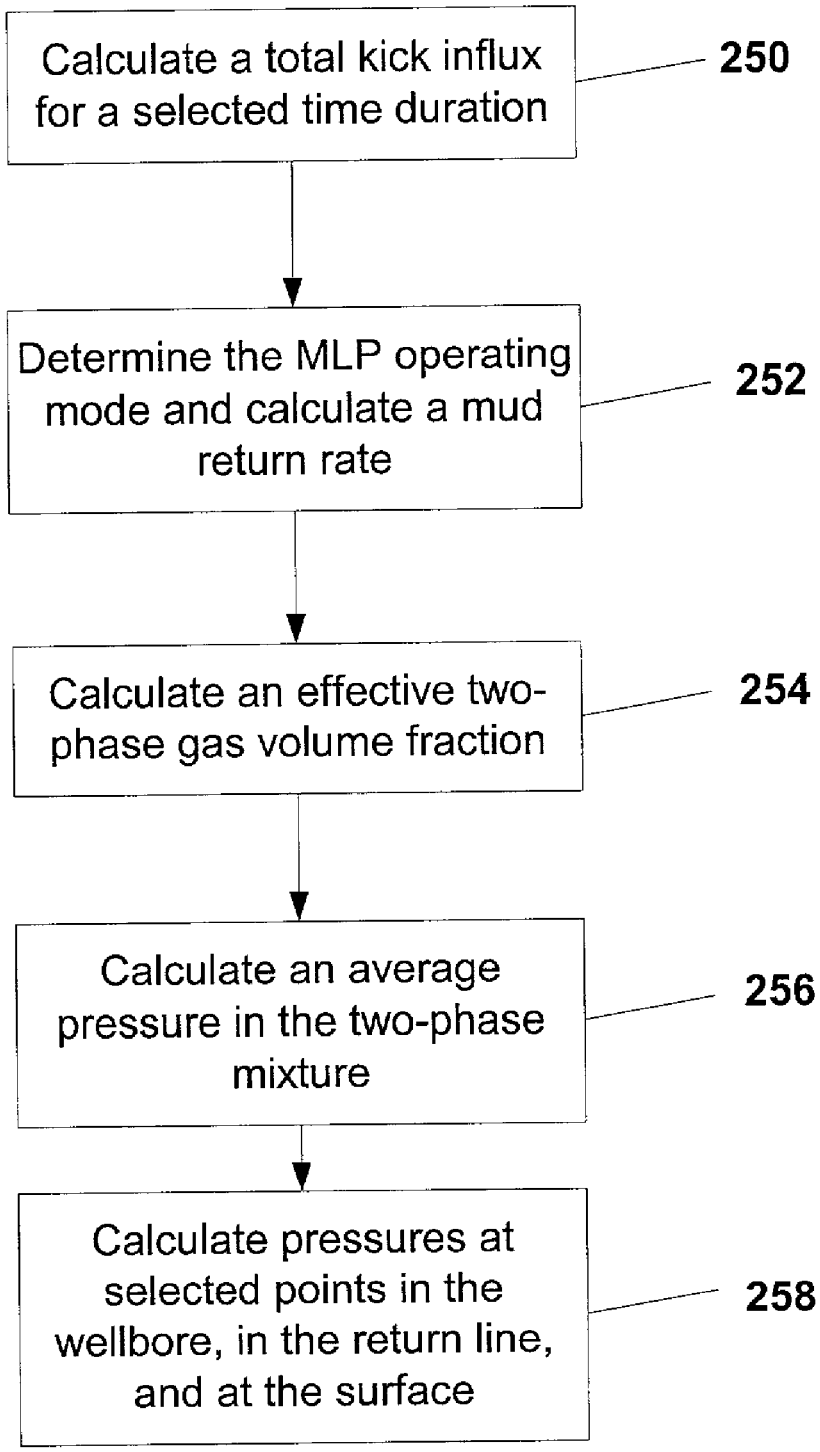
FIG. 8 shows an example of some of the steps included in a kick simulation according to an embodiment of the invention.

FIG. 8 shows some of the steps used to calculate kick characteristics in an embodiment of the kick simulation subroutine:

- Calculate a total kick influx 250 for a selected time duration if the target formation has been penetrated.
- Determine a MLP operational mode and calculate a mud return rate 252 depending on the mode. Note that when the MLP is operating in constant pressure mode and the drill string is not full of mud, a return rate through MLP is typically equal to the U-tube rate plus the kick influx rate.
- Calculate an effective two-phase gas volume fraction 254.
- Calculate an average pressure in the two-phase mixture 256.
- Calculate pressures at points of interest in the wellbore, in return lines, and at the surface 258. Note that the pressure calculations can be obtained from wellbore hydrostatic pressure and friction pressure losses (FPLs) for single-phase or two-phase flow because we know a pressure, a volume, and a location (in the wellbore) of the two-phase mixture.

Although ROP generally continuously varies while drilling, the Choe model uses a substantially constant ROP selected by the user and varies the selected ROP by ±0.5% to simulate variations. Further, the kick influx rate in the Choe model (at any selected time) is limited to be less than the larger of the surface pump rate and 1,000 gpm. This limitation is included so as to avoid overflow due to high gas kick influx rates.

For the kick simulation, the two-phase mixture (of mud and the gas kick) is treated as a slug having an effective gas fraction. This is an approximation for calculating wellbore pressures and experimentation has shown that this approximation correlates well with an unsteady state two-phase model because of relatively high gas densities and relatively low gas expansion rates near the bottom of the wellbore.

Simulating a Kick in a Partially Full Drillstring—Constant Pressure Mode

If the subsea mudlift pump (MLP) is operating in a "constant pressure mode," the MLP is operated to maintain a selected inlet pressure by adjusting a MLP flow rate. If the MLP is operating in a "constant flow rate mode," the MLP is operated to maintain a constant flow rate. For the purposes of the Choe model, it is assumed that MLP operating modes may be changed at any time by the user.

In some simulations, the drillstring is not full of mud while the MLP is operating in the constant pressure mode. A kick can occur any time that the BHP is less than formation pressure and total depth is greater than the target depth. The surface pump rate is generally determined by a user input via the graphical user interface (GUI), and because the drillstring is not full of mud, the MLP rate (in these embodiments) should be determined so as to establish dynamic equilibrium in the well (otherwise, the MLP inlet pressure will change). If a kick enters the well, the return rate from the MLP will increase by an amount equal to a flow rate of the gas influx.

Note that although the MLP inlet pressure will not change with a kick (when the MLP is operating in constant pressure mode), the BHP will change, and will likely decrease because of reduced hydrostatic pressure due to the gas kick influx. If the BHP changes, it will affect mud level inside the drillstring (e.g., the mud level in the drillstring will drop as BHP decreases). The change in mud level inside the drillstring (Δh) is described in Equation (20):

$$\Delta h = -\frac{\Delta BHP}{0.052\rho_{mud}}. \tag{20}$$

Simulating a Kick in a Partially Full Drillstring—Constant Flow Rate Mode

Although a user can change MLP operating mode any time, in actual SMD operations the constant flow rate mode is not generally used when the drillstring is not fill of mud because the MLP would be operated to maintain an output flow rate regardless of the MLP inlet pressure, as long as the MLP inlet pressure is within its operational limits. Operating in constant flow rate mode may induce variations in MLP inlet pressure that make it difficult to detect (and control) a kick. Moreover, if the MLP flow rate is less than the desired flow rate, the BHP will typically increase because the mud level inside drill string does not drop as required to provide the specified MLP flow rate. The BHP may increase to a level greater than a formation fracture pressure so that the wellbore structure is damaged. The change in bottom hole pressure (BHP) may be determined using Equations (21) and (22):

$$\Delta BHP = 0.052\rho_{mud}\Delta h - \frac{\Delta p_f}{\Delta L}\Delta h \tag{21}$$

$$\Delta h = (Q_{pump} + Q_{influx} - Q_{SSP})\frac{\Delta t}{42\cdot 60} \Big/ DP_{capacity} \tag{22}$$

where $Q_{pump}$ is the surface pump rate (in gpm), $Q_{influx}$ is the kick influx rate from the formation (in gpm), $Q_{SSP}$ is the subsea mudlift pump circulation rate, Δt is the time duration (in sec.), $DP_{capacity}$ is drill pipe capacity (in bbls/ft), ΔBHP is the bottom hole pressure change over Δt (in psi), and Δh is the height change due to bottom hole pressure change (in ft). $\rho_{mud}$ is the mud density (in ppg), and $\Delta p_f/\Delta L$ is the FPL per unit length (psi/ft).

Simulating a Kick in a Full Drillstring—Constant Pressure Mode

When the drillstring is full of mud, the MLP flow rate is a summation of surface pump rate and kick influx rate (if any). If there is a kick in the wellbore, the BHP will vary while the MLP inlet pressure remains constant and there will generally be a return rate increase as one of the kick indicators.

Simulating a Kick in a Full Drillstring—Constant Flow Rate Mode

When the MLP is in constant flow rate mode, the MLP inlet pressure will change depending on the selected MLP rate. If the MLP rate is equal to the surface pump rate, the circulation system will typically be in a steady state condition if there is no kick in the wellbore. As described in detail above, any kick influx will increase the system pressure by compressing the mud and kick volume in the system.

III. Subsea Mudlift Drilling Well Control Simulation: Automatic and Manual Control The simulation of the Choe model incorporates the above referenced parameters and calculations into subroutines adapted to model subsea mudlift drilling (SMD) operations and, more specifically, to model well control aspects of SMD operations. The following description shows how the simulation may be used for both training and real-time well control operations. Two control modes, automatic and manual, will be described in detail below. Both of these well control modes may be used for training (e.g., by retrieving simulated or actual wellbore data from a memory) or for real world, real-time well control application (e.g., by operatively coupling the well control simulation to real-time data acquired from an operating well). Flowcharts are presented in the discussion to outline some of the aspects of the invention. However, while the flowcharts describe some of the steps in the simulation and control procedure, they are provided for illustrative purposes only and are not intended to limit the scope of the invention to the exact sequences shown therein.

Figure 9:
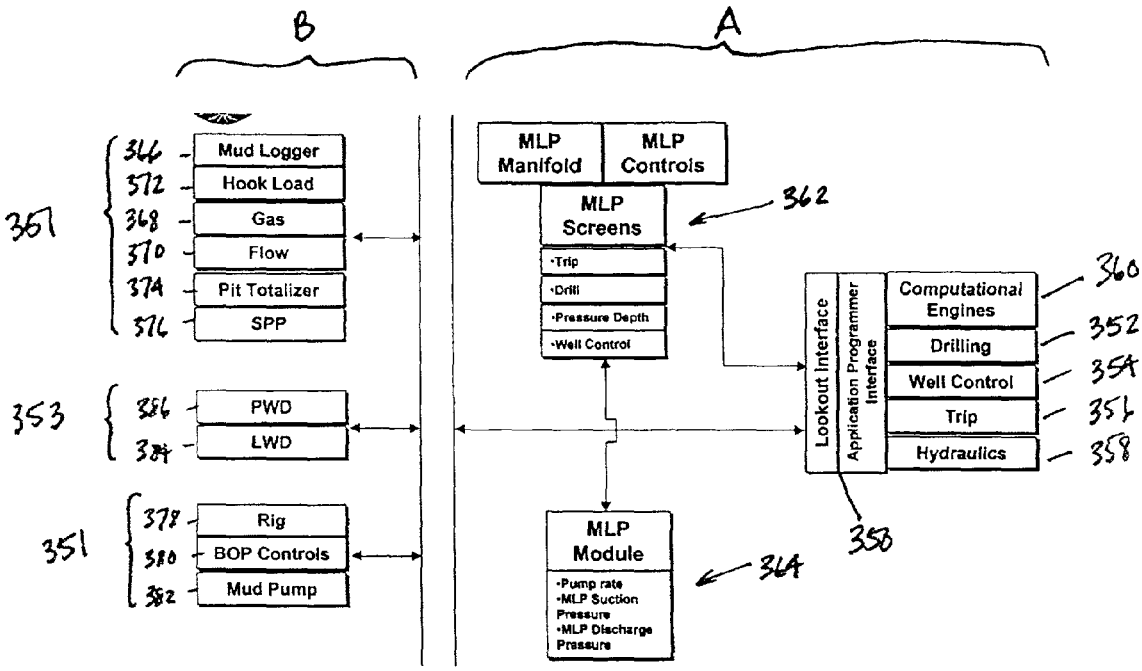
FIG. 9 shows a schematic view of an embodiment of the invention.

FIG. 9 shows a schematic view of an embodiment of the Choe model simulation A. An application interface 350 comprises a graphical user interface (GUI) that enables display and control of, for example, drilling operations 352, well control operations 354, drillstring trip operations 356, and circulation system hydraulics 358. Moreover, as described above, the GUI serves as an interface through which users may select, among other options, the type of computational engine 360 that is used to model wellbore and circulation system hydraulics.

The application interface 350 is operatively coupled to a mudlift pump (MLP) simulation module 364 and a simulation module 362 that includes, for example, MLP controls and displays as well as default data concerning wellbore conditions, circulation system configurations, and the like. The MLP simulation module 364 and the simulation module 362 may be used to simulate SMD and well control operations as a stand-alone training simulator or as a real-time well control system as described below.

The application interface 350 is also operatively coupled, in some embodiments, to a real-time interface B so that actual, real-time well data may be input into the Choe model simulation A. In this embodiment, the real-time interface B may be used to collect well data that may be used for training purposes. However, the real-time interface B may also be adapted to permit a user to automatically or manually control a well as described in detail below. The real-time interface B, as shown in FIG. 9, includes rig data 351 (such as, for example, mud logging data 366, gas content information 368, flow rate and volume information 370, hook load data 372, pit volume information 374, standpipe pressure 376 (SPP), rig control data 378, blowout preventer control information 380, surface mud pump information 382, and the like) as well as "while-drilling" data 353 that may be measured by, for example, downhole tools, downhole sensors, and the like. The while-drilling data 353 may be determined, for example, by logging while drilling (LWD) tools 384 and pressure while drilling (PWD) sensors 386.

Figure 10:
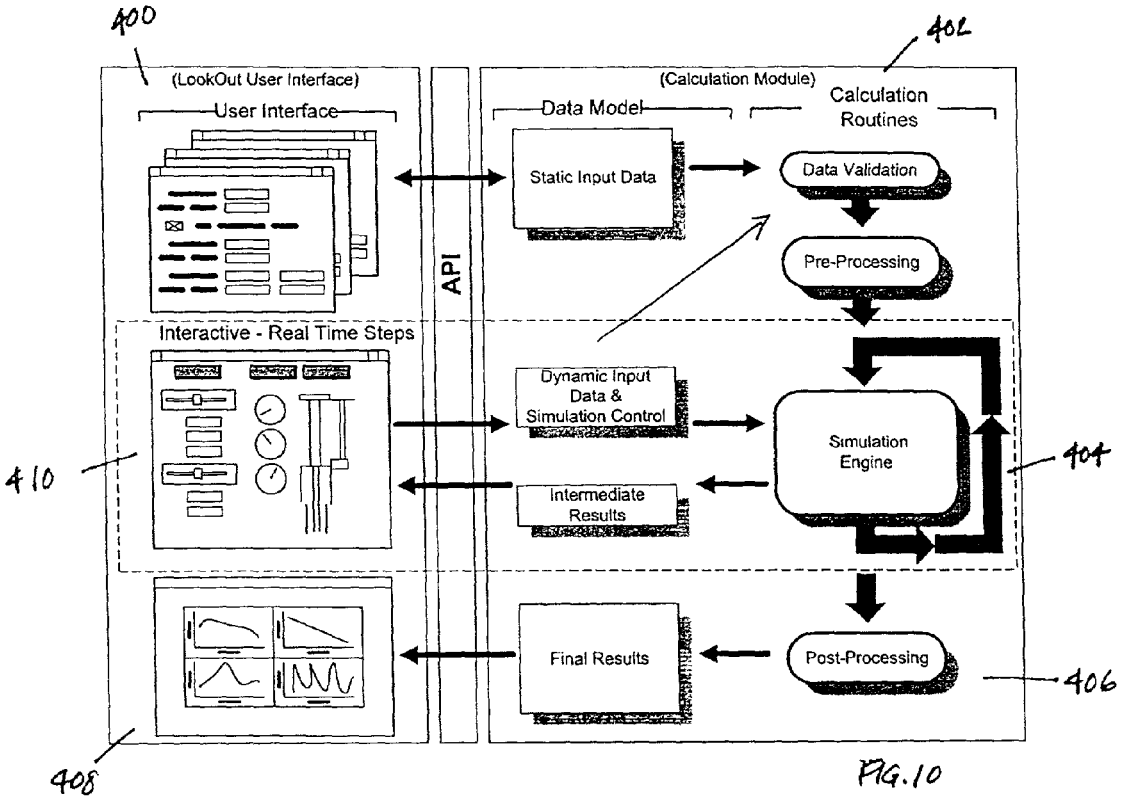
FIG. 10 shows a schematic view of an embodiment of the invention including real-time data transfer.

FIG. 10 shows another schematic view of an embodiment of the invention that comprises a real-time well control system coupled to the Choe model simulation. This embodiment comprises operatively connected elements including a user interface 400, a data and calculation module 402, a simulation engine 404, a post processing module 406 and output display 408, and a real-time interface 410 that is adapted to permit real-time control of a well. For example, a user may, for example, input data or select a computational engine using the user interface 400. Input data and default data may be used in the data and calculation module 402, which performs many of the subroutine calculations described above so as to model a SMD system. The calculated data may be passed to the simulation engine 404 so that simulation subroutines (including drilling, well control, and the like) may be run. Results of the simulation may be passed to the post processing module 406 so that the results may be numerically and graphically presented via the output display 408.

Alternatively, or in parallel with the simulation based on stored or user provided data, a real-time interface 410 may be used to provide real-time well data to the simulation engine 404. In this aspect of the invention, real-time data may be input into the data and calculation model 402 so that real-time well control aspects may be simulated by the simulation engine 404. After simulation of the real-time data, well control processes included in the simulation engine 404 may be used to perform real-time well control operations through the real-time interface 410. Note that both real-time and simulated well conditions and well control procedures may be displayed via that output display 408 and that the user interface 400 is operatively coupled to the real-time interface 410 so that users may perform real-time well control inputs.

The embodiments shown in FIGS. 9 and 10 are provided to show exemplary embodiments of the invention. Accordingly, the arrangement of modules, flow of data, and the like are not intended to limit the scope of the invention. Other hardware and software arrangements are contemplated for use with the invention.

Figure 11:
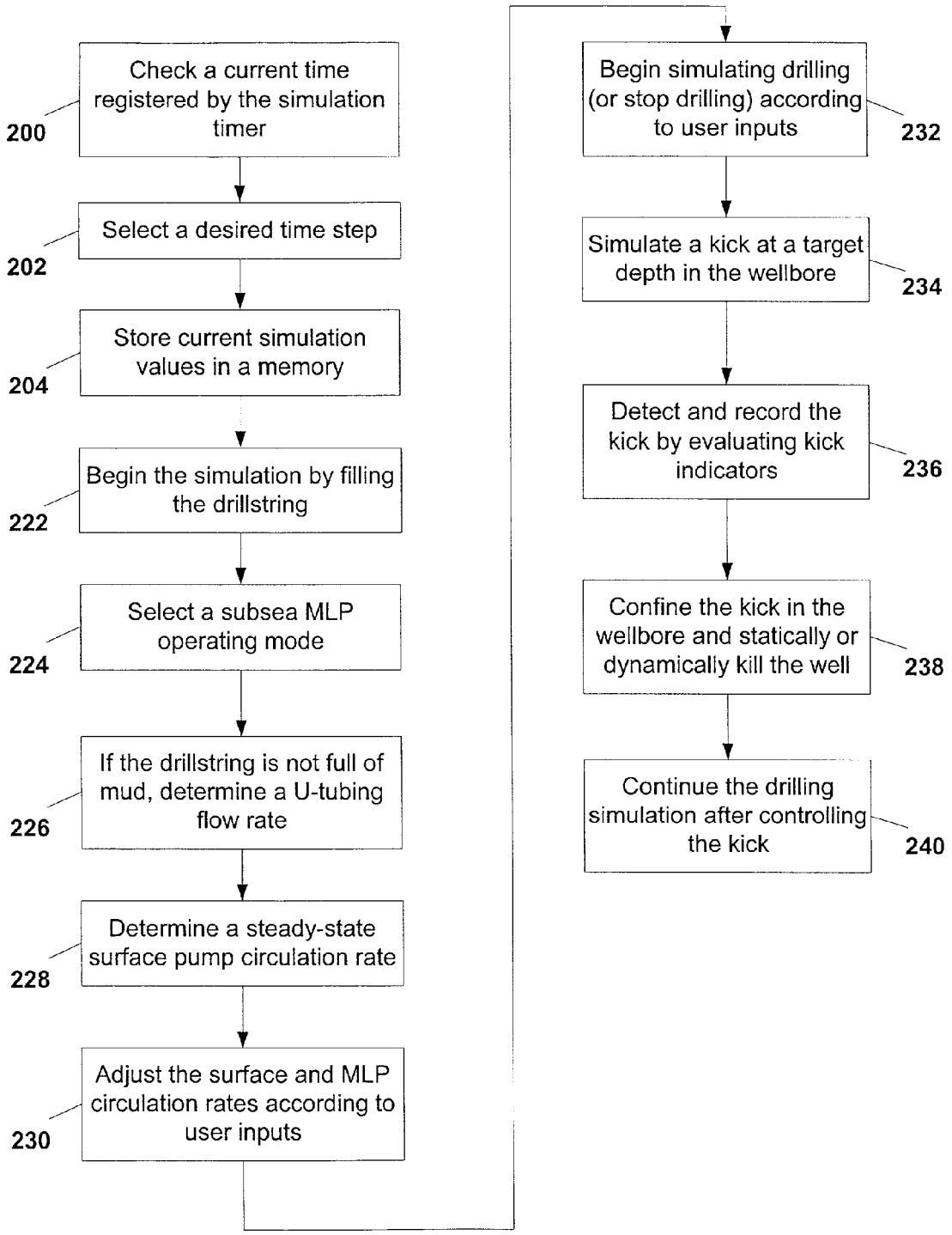
FIG. 11 shows an example of some of the steps included in a kick simulation according to an embodiment of the invention.

The main simulation module of the Choe model is controlled by at least one timer (as described below, however, the automatic control mode may include, for example, four separate timers). Subroutines adapted to calculate various wellbore and kick parameters are called in a sequence controlled by the timer. FIG. 11 shows a flowchart of a logic sequence in one embodiment of the invention. A first step 200 in the simulation includes a check of a current time as registered by the timer. Next, a desired time step 202 is determined from a user selected simulation ratio (e.g., the user may select that the simulation be run in real-time, a multiple of the real-time rate, and the like). At this point, current values used in the simulation are stored in a memory 204. FIG. 11 shows additional kick simulation steps included in an embodiment of the simulation:

Begin the simulation by filling the drillstring 222.

Select a subsea MLP operating mode 224 (e.g., "Constant Pressure Mode" or "Constant Flow Rate Mode") and, if the drillstring is not full of mud, determine a U-tubing rate 226.

Determine a steady state surface pump circulation rate 228 after the drillstring is full of mud.

Adjust surface or MLP circulation rates 230 according to user inputs.

Begin simulating drilling or stop according to user inputs 232. Note that in some embodiments drilling is simulated by using half of a specified rate of penetration (ROP) before reaching a target depth (e.g., at which a kick occurs) and the full ROP after reaching the target depth to simulate a drilling break as a kick indicator.

Simulate a kick at 234 (as described in detail below) at a target depth (e.g., at a target formation) if a bottom hole pressure (BHP) is less than a formation pressure.

Detect and record the kick 236 by evaluating kick indicators (including, for example, mud pit gain, changes in MLP inlet pressure, changes in BHP, and the like) (note that the BHP may increase or decrease depending on MLP operational mode and a difference in flow rate between the MLP and the surface pump(s)).

Confine the kick and statically or dynamically kill the well 238.

Continue the simulation 240 after controlling the kick.

Note that these are only a few of the steps involved in the Choe model simulation and that they are provided to clarify the invention rather than limit the invention to the specific steps shown above. Moreover, as described above, parameters such as pump rates and pressures may be input into the simulation in real-time so that actual kicks may be detected and controlled in real-time while monitoring a dynamic state of the well using the Choe model.

The Choe model is adapted to simulate well control procedures wherein well control may be performed automatically (e.g., using software driven well control inputs) or manually (e.g., using user input well control parameters). The following discussion describes aspects of both automatic and manual control that are characteristic of embodiments of the invention.

Calculations in the automatic control mode require iterative procedures to determine, for example, a MLP inlet pressure and a surface choke pressure required to control a kick. In contrast, the manual control mode uses user input MLP inlet pressure and surface choke pressure to control the kick. To run the automatic and manual control modes of the kick simulation, user input data and initial kick conditions can be imported from data files generated by the procedures described above (e.g., from data files stored in a memory). Alternatively, the kick simulation also includes default values stored in a memory that may be used in the absence of user inputs. Finally, data may be imported into the subroutines in real-time so that the kick simulation model may be used to control a well in real-time.

Automatic Control

The automatic control mode, as described above, comprises a plurality of automated well control calculations and procedures. A detailed description of the automatic control mode follows.

During drilling and well control operations, a differential pressure between an inlet and an outlet of the MLP may be less than 500 psi and may even be negative, especially when a large kick has entered the wellbore or when a kick occurs at a shallow water depth. Generally, differential pressure across the MLP must be maintained at about 500 psi in order to prevent back flow through the MLP. For manual control, the surface choke must be manually adjusted to maintain the minimum differential pressure. For automatic control, a software routine can adjust the surface choke to maintain the minimum differential pressure. In some embodiments, the automatic control mode maintains the minimum differential pressure at the MLP by maintaining a minimum pressure at the top of the kick of approximately 1000 psi (note that this value may be changed via user input). The subroutine is therefore adapted to adjust the surface choke to maintain at least 1,000 psi at the top of the kick.

The 1000 psi minimum pressure at the top of the kick helps avoid excessive kick expansion. However, although minimum pressure at the top of the kick may be estimated, it is difficult to use real-time well data to determine this pressure. Accordingly, absent well data regarding pressure at the top of the kick, the default minimum of 1000 psi (or a user adjustment thereof) is used in embodiments of the invention. However, it is contemplated that measured data may be substituted for the default, and the use of the default pressure is not intended to limit the scope of the invention.

Figure 12:
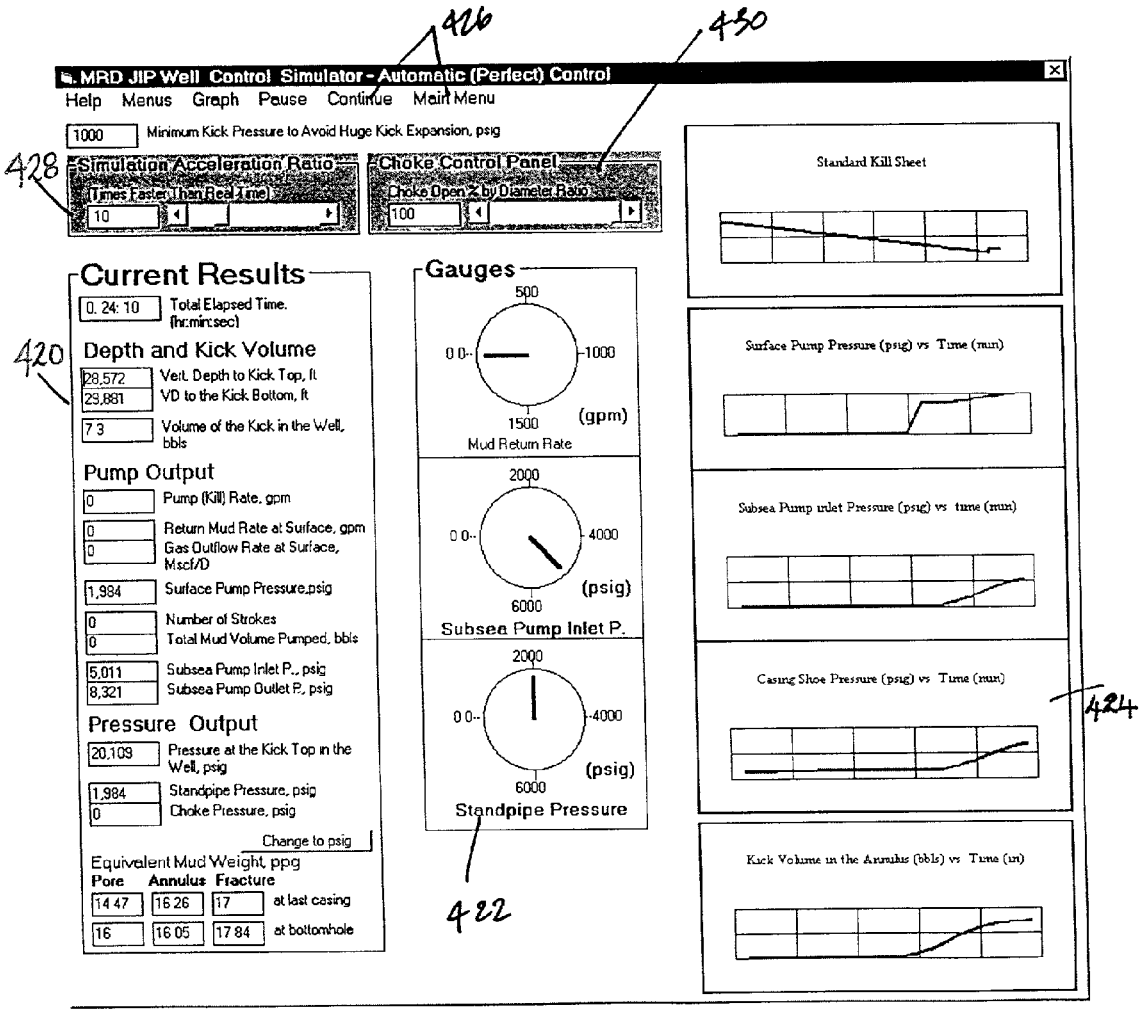
FIG. 12 shows an example of a graphical user interface used in an embodiment of the invention.

FIG. 12 shows a view of a GUI screen for automatic control. Initial conditions are shown using, for example, digital displays 420, analog gauges 422, and graphs 424. The user may operate the automatic control mode using menus 426 at the top of the screen, and the simulation rate 428 can be adjusted (e.g., to reflect multiples of "real-time"). Note that the choke control 430 cannot be adjusted because the automatic control simulation controls choke opening status. Because well control procedures follow pre-specified sequences, the Choe model uses four timers for step by step calculations. The manual control mode only uses one timer for well control procedures because of the dependency on user inputs rather than on automated sequences.

The timers used in the automatic control mode include a first circulation timer (adapted to control the well control procedure as the kick moves from the wellbore to the MLP), a second circulation timer (adapted to control the well control procedure as the kick moves through the MLP and to the surface), a third circulation timer (adapted to control the well control procedure as the kick moves from the return line and through the surface choke), and a Driller's Method timer (adapted to control the well control procedure as the kill weight mud is circulated through the well using the Driller's Method).

A variable is used in the subroutines of both the automatic and manual control modes to limit a gas volume fraction below 0.45 for the first layer of the mixture. This criterion was proposed by Choe in "*Dynamic Two-Phase Well Control Models for Water-Based Muds and Their Computer Applications*," Ph.D Dissertation, Texas A&M University, College Station, Tex. (1995), during the development of an unsteady state two-phase model. Because gas expansion is dominant near the surface, a single-phase model typically predicts higher kick volume and, therefore, higher surface choke pressures for conventional well control. For an unsteady state two-phase model, the two-phase mixture expands due to gas slip, and the limitation on gas volume fraction helps account for the effects of gas slip in the two-phase mixture.

Pore and fracture pressure information is available in terms of equivalent mud weight (EMW) or pressure both at the casing shoe and proximate the bottom of the well. These pressures are used to determine other pressures in the wellbore. As described above, three methods including user inputs, Barker's method, and Eaton's method may be used to calculate pore and fracture pressures.

A kill sheet is prepared by both the automatic and manual control simulations. The kill sheet enables monitoring of, for example, standpipe pressure vs. time so that a substantially constant BHP may be maintained to prevent additional kicks from entering the wellbore. Pressures used in the kill sheet are directly calculated from the formation pressures. Note that standpipe pump pressure is generally equal to the friction pressure loss (FPL) minus the difference between formation pressure and hydrostatic pressure. FPL includes pressure losses through drillstring, the drill bit, and a DSV (if included in the drillstring).

Figure 13:
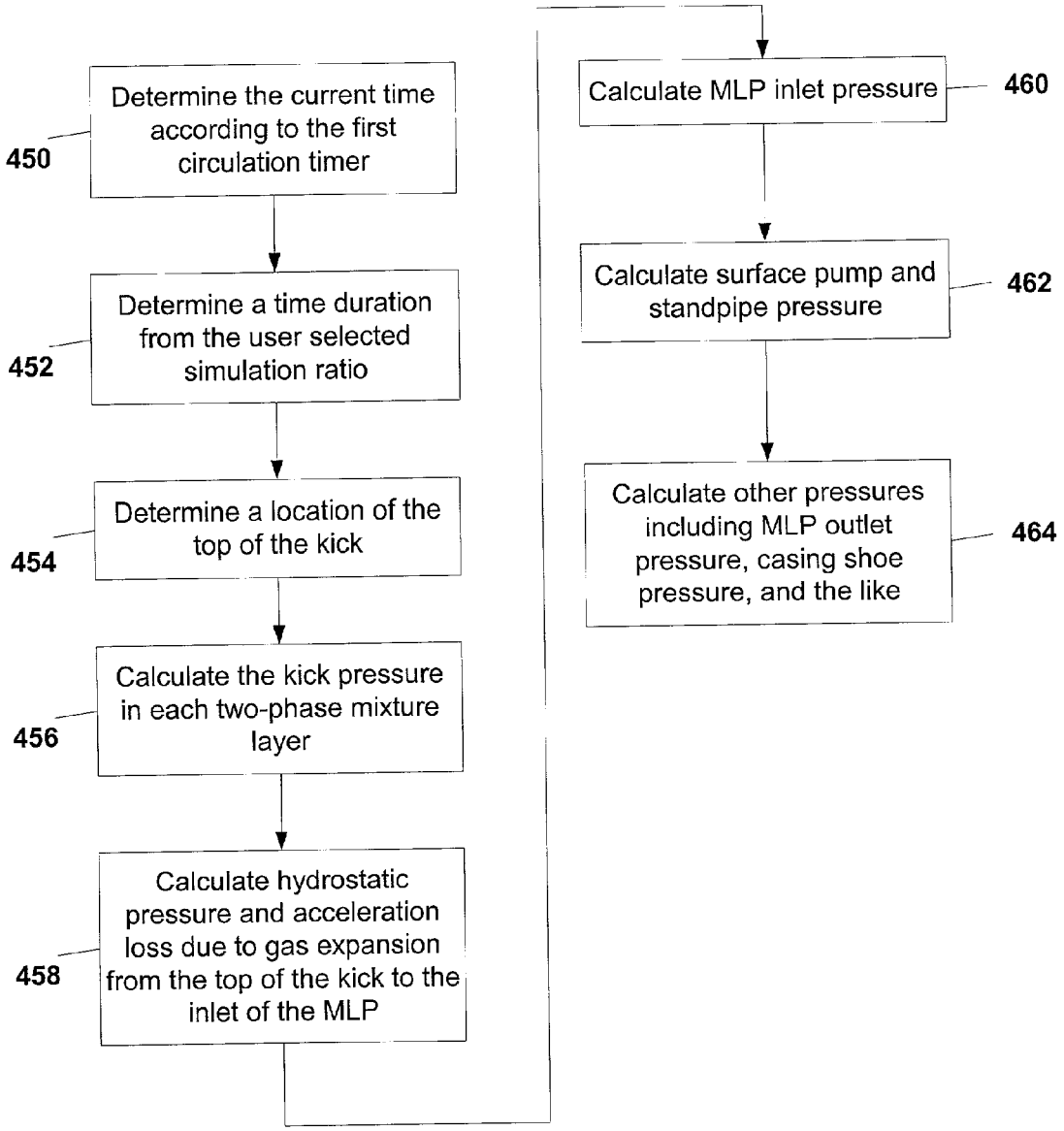
FIG. 13 shows an example of some of the steps included in an embodiment of the invention.

The First Circulation Timer—Circulation of the Kick from the Formation to the MLP The first timer controls the automatic well control mode from the start of kick circulation to until the kick reaches MLP. Control in this regime is relatively simple because the gas kick is only in the wellbore below the mud line (BML), and gas expansion is relatively minor due to combined effects of pressure and temperature. FIG. 13 shows some of the steps performed according to the first circulation timer:

- Determine the current time 450 according to the first circulation timer;
- Determine a time duration from the user selected simulation ratio 452;
- Determine a location of the top of the kick 454;
- Calculate the kick pressure in each two-phase mixture layer 456.
- Pressure at the top of the kick mixture is adjusted until the BHP is within a convergence criterion of the bisection method. After a solution has converged, the solution may be used to determine other information about the two-phase mixtures including pressure, volume, density, gas volume fraction, and top and bottom locations of each two-phase mixture layer.
- Calculate hydrostatic pressure and acceleration loss due to gas expansion from the top of the kick to inlet of MLP 458 (e.g., to the mud line). Relatively high gas expansion rates result in increased acceleration loss (of the kick) due to an accompanying increase in flow rate. The increased flow rate results in an increased FPL and a low MLP inlet pressure.
- Calculate a MLP inlet pressure 460.
- Calculate a surface pump and standpipe pressures 462.
- Calculate other pressures in the circulation system including MLP outlet pressure, casing shoe pressure, and the like 464.

The location of the top of the kick may be determined using the methods described above. MLP inlet pressure and kick pressure are determined as follows. The software subroutine uses a bisection method, also referred to as the "Golden section method," because the kick pressure is generally between the formation pressure (e.g., the BHP) and a surface standard pressure (e.g., zero psig). After determining the kick pressure, a MLP inlet pressure can be calculated by subtracting hydrostatic pressure and FPL from the kick pressure at the top of the two-phase mixture layers (e.g., at the top of the kick). A similar subroutine is used to determine a MLP inlet pressure that generates a BHP that is at least equal to the formation pressure so as to prevent additional kicks from entering the wellbore.

The Second Circulation Timer—Circulation of the Kick Through the MLP

The second circulation timer subroutine processes kick circulation through the MLP and kick migration to the surface. For large kicks, the top of the kick may reach the surface choke while a portion of the is kick still below the MLP. The subroutine provides for decreasing a simulation ratio to five times faster than real-time if the top of the kick passes a middle of the return line (while a portion of the kick remain below the MLP) so that kick expansion may be properly determined. Calculation procedures are very similar to those used in the first circulation time subroutine, but kick pressure calculations are slightly different because there is now a two-phase mixture in the return line and in the wellbore BML. Both a portion of the kick pumped through the MLP and the portion remaining BML must be carefully tracked.

Kick pressures BML are calculated using the same method described above. However, the kick pressure in the return line is calculated in a manner similar to that described above, and differential pressure across the MLP is also considered. If all of the two-phase mixture is located BML, a top location of the mixture may be determined and a bottom of the kick can be determined using the real gas law.

However, if kick lies both in the return line and in the wellbore BML, a different approach must be used. In this approach, the top of the two-phase mixture is calculated using a selected bottom location of the mixture in the return line. Further, the bisection method may not be used because of high gas expansion rates near the surface. Accordingly, a simple "marching" technique, which moves from location to location in fixed increments, is used to locate the top of the 2-phase mixture in the return line. In some embodiments, the method first searches 100 ft increments (and then 5 ft increments after determining a solution within 100 ft). Note that embodiments of the Choe model generate an alarm if the method fails to converge for a selected number of iterations (e.g., 1,000 iterations). The method generally converges within ten iterations unless a kick is very large or if the return line has a small inner diameter.

Figure 14:
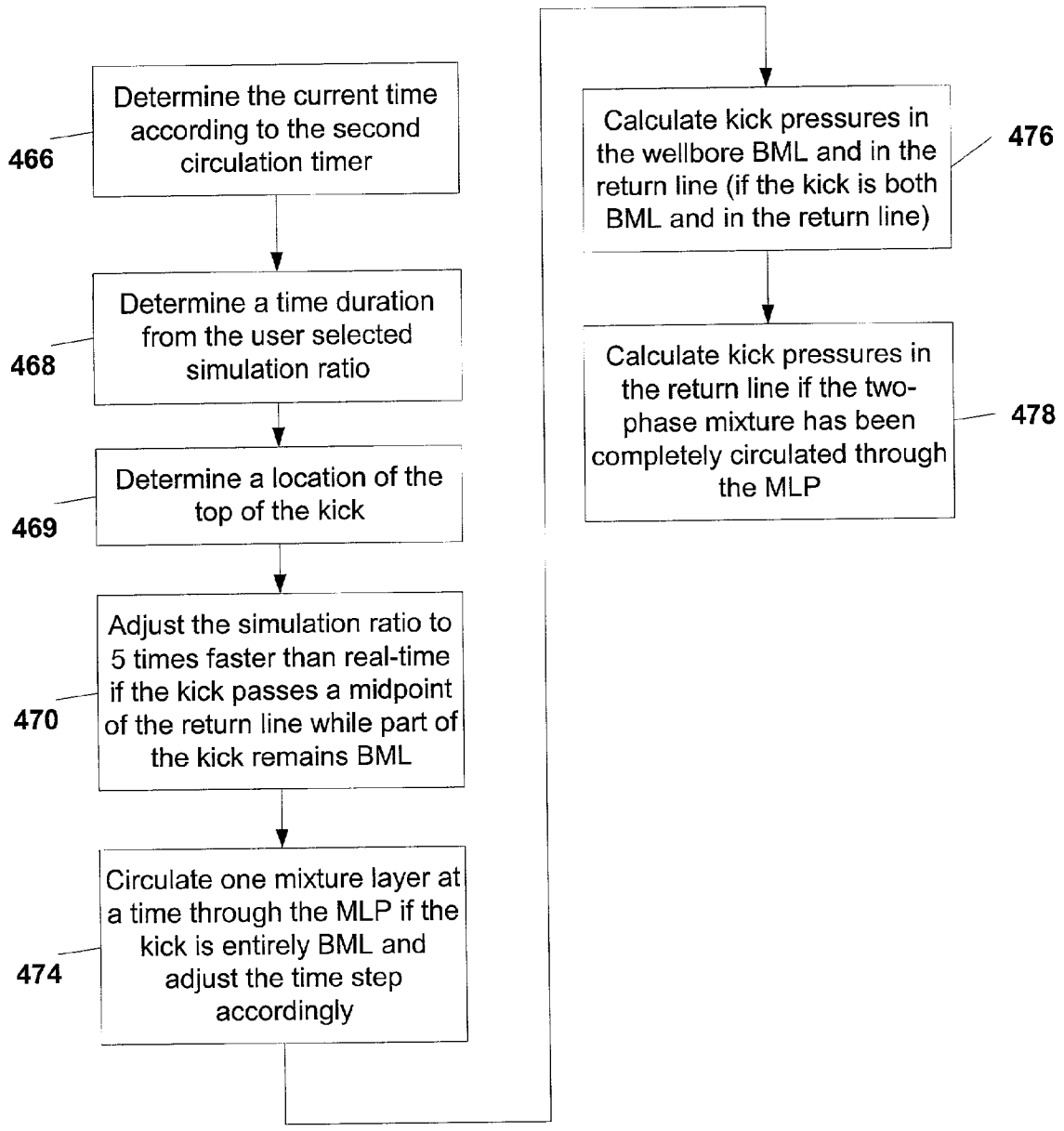
FIG. 14 shows an example of some of the steps included in an embodiment of the invention.

FIG. 14 shows some of the steps performed according to the second circulation timer. The steps include (among other steps):

- Determine the current time 466 according to the second circulation timer;
- Determine a time duration from the user selected simulation ratio 468;
- Determine a location of the top of the kick 469;
- Adjust the simulation ratio from the default of 10 to 5 times faster than real-time if the gas kick passes a midpoint of the return line 470.
- Circulate one mixture layer at a time through the MLP if the kick is entirely BML and adjust the time step accordingly 474.
- Calculate kick pressures in the wellbore BML and in the return line 476 using the methods described above if a portion of the kick is BML and a portion of the kick is above the mud line.
- Calculate kick pressures in the return line as described above 478 (note that if the kick pressure in the return line is less than the minimum pressure specified as input data (e.g., less than 1000 psi), the kick pressure will automatically be adjusted to the minimum pressure).

The Third Circulation Timer—Circulation of the Kick from the Return Line through the Surface Choke The third circulation timer subroutine is enabled when the two-phase mixture is only present in the return line (e.g., when the kick is entirely above the mud line). Because this subroutine is based on automatic control, there will be no secondary kick in the wellbore because BHP is automatically maintained at a selected level above the formation pressure.

In this embodiment of the subroutine, the kick is pumped out of the return line proportional to a gas migration velocity (as determined from the methods described above). As in the previous subroutine, if the kick pressure falls below the minimum value, the kick pressure is automatically adjusted to the minimum pressure.

The Driller's Method Circulation Timer

This subroutine is only activated when the Driller's Method is used for SMD well control. Because only single-phase flow calculations are used in the subroutine, all calculations are relatively simple. For example, all gas related variables are initialized to zero before calculations are performed.

The automatic control simulation has been developed to show different steps in the well control process and to illustrate the consequences of each step. The automatic control simulation is a valuable training tool that introduces users to well control procedures and prepares them for manual control situations. Moreover, it is within the scope of the invention that the methods used in the automatic control simulation may be used with real-time data to simulate actual well control scenarios. The real-time data and automatic control methods may also be used to automatically control a kick on an operating rig.

Manual Control

The manual control subroutine enables a user to provide inputs and to thereby actively participate in the well control procedure. Accordingly, the manual control subroutine is useful in training methods of well control. Further, if the system is coupled to a source of real-time well data, the manual control method may be used by an operator, in some embodiments, to actively control a well. Therefore, while simulation is useful for training, it is not intended to be limited solely to training purposes.

In some embodiments, the user may choose a choke control method (e.g., automatic or manual control) from a menu at the very beginning of the simulation. The GUI screen layout is very similar for both the automatic and manual control regimes. A difference between manual and automatic control is that the user may input parameters including, for example, a MLP flow rate and a surface choke control input so as to determine pressures in the circulation system. Accordingly, BHP is not necessarily constant and there may be multiple kicks if the user inputs maintain the BHP below a formation pressure.

Manual Control Timer

Figure 15:
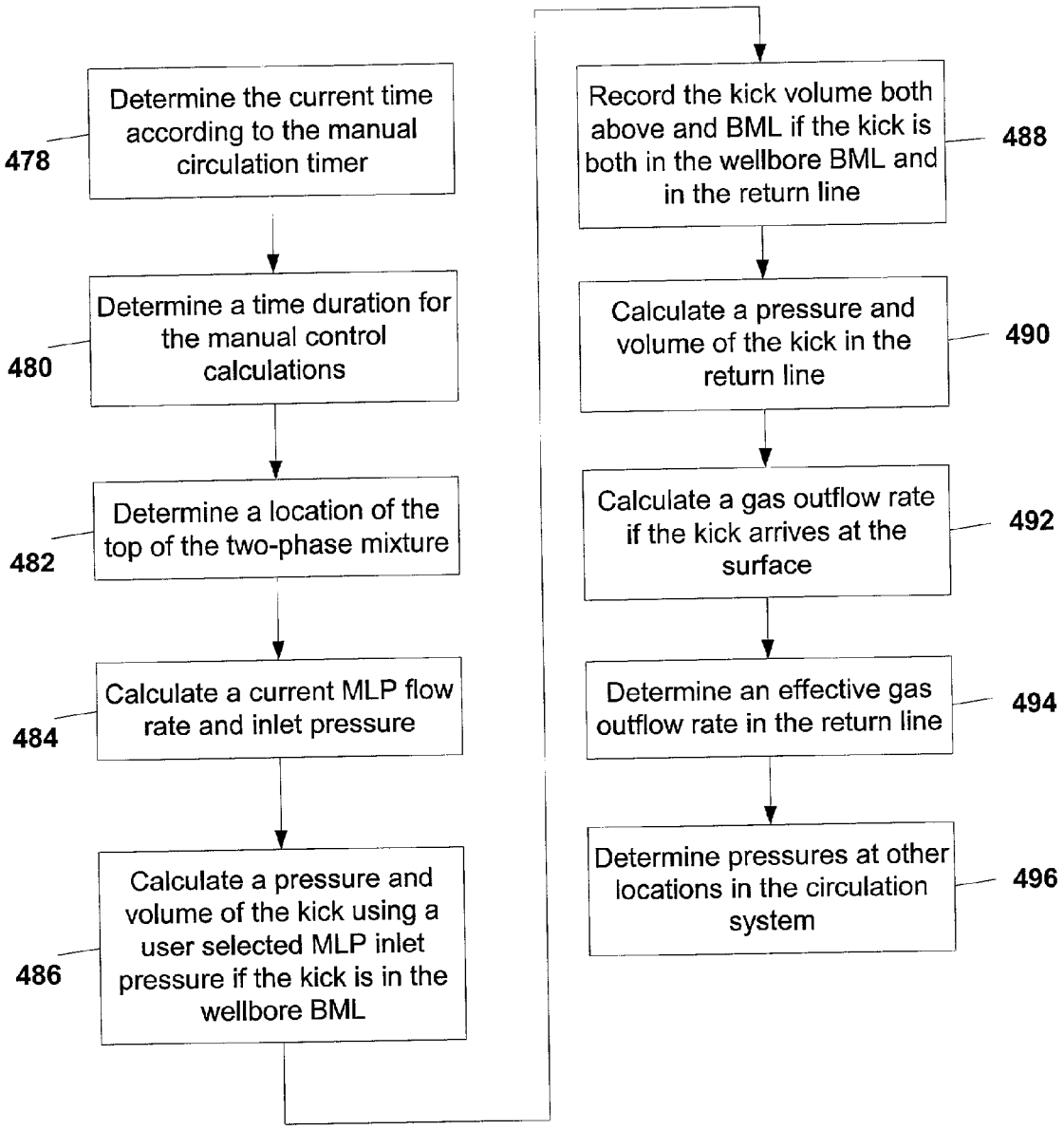
FIG. 15 shows an example of some of the steps included in an embodiment of the invention.

In the manual control model, one timer is generally used to control calculations, and most calculations are based on a selected time duration. Some of the steps performed according to the manual control timer are shown in FIG. 15 and include, among other steps:

- Determine a current time according to the manual control timer 478.
- Determine a time duration for the manual control calculations 480.
- Determine a location of the top of the two-phase mixture 482.
- Calculate a current MLP flow rate and inlet pressure 484.
- Calculate a pressure and volume of the kick using a user selected MLP inlet pressure 486 if the kick is in the wellbore BML.
- Record a kick volume both above and BML 488 if the kick is both in wellbore (BML) and in the return line. The kick volumes are used to calculate an instantaneous flow rate.
- Calculate a pressure and volume of the kick in the return line 490.
- Calculate a gas outflow rate 492 using surface choke valve characteristics as described in detail below if the kick arrives at the surface.

Determine an effective gas outflow rate in the return line 494. Note that a differential flow rate is determined from a gas kick expansion for the selected time interval.

Because the pressures and volumes of the kick mixture and the flow rate in return line are all known parameters, pressures at different positions in the circulation system may now be determined 496.

In some embodiments of the invention, the flow rate in the return line may be changed within a range from about 80% to about 125% of a previous flow rate. A limitation on an amount of incremental change in the return line flow rate may be required so as to prevent flow rate and pressure oscillations in the modeled circulation system.

Calculating Pressure Losses Through the Surface Choke

For a single-phase flow, pressure losses through the surface choke are determined using the equation for pressure loss through a drill bit (see, e.g., Equation (3)). However, for two-phase flow, equations available in Brill and Beggs (1984) are used:

$$d_{cv} = 1.128\left(\frac{8.311e-5\rho_{mix}q_{mix}^2}{C_d^2\Delta p_{cv}Y}\right)^{0.25} \tag{23}$$

$$\rho_{mix}=\rho_g H_g+\rho_l H_l \tag{24}$$

$$Y = 1.0-\left[0.41+0.35\left(\frac{d_{cv}}{d_1}\right)^4\right]\frac{1}{k}\frac{\Delta p_{cv}}{p_{up}} \tag{25}$$

where $\Delta p_{cv}$ is the pressure drop across the surface choke valve, $C_d$ is a choke valve discharge coefficient (typically selected to be 0.95 in the Choe model), Y is a gas expansion factor, $d_{cv}$ is a current inner diameter of the surface choke valve, $d_i$ is a fully open inner diameter of the surface choke valve, k is a ratio of specific heats of the gas, $\rho_{mix}$ is a gas-mud mixture density in ppg, $q_{mix}$ is a total gas-mud mixture flow rate in gpm, and $p_{up}$ is a pressure upstream of the surface choke valve in psia. Note that numerical iteration is required to calculate $\Delta p_{cv}$.

Determining a Surface Choke Flow Rate for a Selected Pressure

In the manual control simulation, calculation of the surface choke flow rate at a given pressure is very important. For example, the surface choke flow rate directly determines mud and gas outflow rates. For single-phase flow, the surface choke flow rate is again determined from the bit nozzle pressure loss equation (see, e.g., Equation (3)). However, the choke pressure loss equations (see Equations (23), (24), and (25) above) for two-phase flow are sensitive to small gas expansion factor (Y) values. In the manual control simulation, a minimum value of Y is set to be 0.2. Note that if an effective gas fraction of flow through the surface choke is less than 0.01, the manual control simulation assumes single-phase flow.

Note that, in some embodiments of the simulation, surface choke pressure losses determined using the single-phase equation do not exactly correspond to surface choke pressure losses determined using the two-phase equations. Therefore, there may be pressure discontinuities when surface choke pressure loss calculations are performed at the top and bottom of the kick.

The referenced manual control simulation is valid for applications of both the Driller's Method and the engineer's method. Also note that, as in the automatic control regime described above, some embodiments of the invention are limited so that the flow rate in the return line may be changed within a range from about 80% to about 125% of a previous flow rate. The limitation may be required so as to prevent flow rate and pressure oscillations in the modeled circulation system.

User Entered Data

Initial gas and reservoir properties may be entered by the user via the GUI or may be determined directly from, for example, sensors positioned in an existing wellbore. For example, when calculating gas influx and wellbore pressure buildup, gas compressibility and total reservoir compressibility must be known. Although these values depend on pressure in the wellbore, some embodiments of the invention use values calculated at initial reservoir conditions. Accordingly, the Choe model includes default values and equations for calculating gas compressibility, initial reservoir compressibility, and other well properties.

Note that the Choe model generally includes default values for all of the variables described herein. The default values may be changed by user entered data or by calculations performed according to the simulation steps described herein. Otherwise, the default values may be substituted with real-time values uploaded from an existing well.

Graphical User Interface for Entry of Data Presentation of Simulation Results

The Choe model includes a graphical user interface (GUI) that is adapted to display both simulated and real-time data, if available. As described above, the GUI may be used to both monitor well control and to input data. Moreover, during and after running drilling simulations, kick simulations, and the like, selected well control variables may be output to the GUI in the form or graphical displays. Variables that may be displayed via the GUI include, but are not limited to: drill pipe pressure, subsea mudlift pump inlet pressure, surface pump flow rate, subsea mudlift pump flow rate, formation pressure, blowout preventer status, isolation line status, drilling fluid density, kill mud weight drilling fluid density, surface choke pressure, true vertical depth (TVD), subsea mudlift pump outlet pressure, bottom hole pressure (BHP), mud pit gain, pore pressure, fracture pressure, and the like. Examples of graphs that may generally be displayed via the GUI include but are not limited to:

Standpipe and choke pressure versus time;
Casing shoe pressure and BHP versus time;
MLP inlet and outlet pressure versus time;
Top and bottom locations of the kick versus time;
Surface pump pressure and mud circulation volume versus time;
Mud out flow rate and gas out flow rate versus time;
Pressure at the top of the kick mixture versus time;
Height of the kick mixture versus time;
Volume of the kick in the wellbore and in return line versus time;
Surface choke percentage open versus time;
Kick influx rate versus time; and
Theoretical kill sheet plots.

Note that real-time data may also be displayed via the GUI. Finally, the Choe model includes provisions for a graphical display of the drillstring in the wellbore and for an animation of a blowout sequence.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of simulating subsea mudlift drilling well control operations using a computer system, the method comprising:

simulating a drilling circulation system, the simulated circulation system comprising at least one blowout preventer, at least one isolation line, at least one surface pump, a subsea mudlift pump, drill pipe, drilling fluid, and a wellbore;

simulating drilling the wellbore at a selected rate of penetration, the simulating drilling a wellbore comprising simulating drilling selected earth formations;

simulating a kick at a selected depth in the wellbore proximate a selected earth formation, the kick simulated as a two-phase mixture comprising drilling fluid and a formation fluid;

simulating controlling the kick, the simulating controlling the kick comprising:

simulating shutting the at least one blowout preventer;

simulating opening the at least one isolation line;

simulating circulating a formation fluid influx out of a well while an inlet pressure of a subsea mudlift pump is adjusted to maintain a substantially constant drill pipe initial circulating pressure;

simulating pumping drilling fluid with a kill mud weight from the surface into the well;

simulating reducing the drill pipe pressure according to a preselected drill pipe pressure decline schedule until the kill mud weight drilling fluid reaches a bottom of the well;

simulating maintaining the drill pipe pressure at a final circulating pressure after the kill mud weight drilling fluid reaches the bottom of the well by adjusting the inlet pressure of the subsea mudlift pump; and simulating circulating kill mud weight drilling fluid from the bottom of the well to the surface at the final circulating pressure;

displaying wellbore parameters via a graphical user interface operatively coupled to the computer system, the wellbore parameters comprising a drill pipe pressure, a subsea mudlift pump inlet pressure, a surface pump flow rate, a subsea mudlift pump flow rate, a formation pressure, a blowout preventer status, an isolation line status, a drilling fluid density, and a kill mud weight drilling fluid density; and repeating the simulating drilling the wellbore after the kick has been controlled.

2. The method of claim 1, further comprising selecting an operating mode of the subsea mudlift pump.

3. The method of claim 1, further comprising processing well data stored in a memory operatively coupled to the computer system, the well data comprising formation pressures, a wellbore temperature gradient, a formation temperature gradient, wellbore geometry, drillstring geometry, and drilled depth.

4. The method of claim 1, further comprising:

determining a U-tube flow rate during the simulating if the drillstring is not full of drilling fluid to enable determining the subsea mudlift pump inlet pressure.

5. The method of claim 3, wherein the well data comprises real-time well data received from sensors and well equipment disposed proximate the wellbore and operatively coupled to the computer system and to the memory.

6. The method of claim 1, wherein the simulating drilling a wellbore comprises simulating drilling at half of a selected rate of penetration before reaching a selected kick depth and simulating drilling at the selected rate of penetration after reaching the selected kick depth.

7. The method of claim 1, wherein the simulating a drilling fluid circulation system comprises simulating a drill string valve, the drill string valve simulated as a choke that induces pressure losses in the circulation system.

8. The method of claim 1, wherein the simulating a kick comprises simulating a total flow comprising drilling fluid and formation fluid, wherein the kick is simulated as bubble flow if a gas fraction of the total flow is less than 25%, slug flow if the gas fraction is greater than 55% and less than 75% of the total flow, and annular flow if the gas fraction is greater than 90% of the total flow.

9. The method of claim 1, wherein the controlling a kick comprises:

determining a location of a top of the kick;

calculating a kick pressure in each of at least two layers defined within the two-phase mixture;

calculating hydrostatic pressure and acceleration losses due to gas expansion from the top of the kick to an inlet of a subsea mudlift pump using the calculated kick pressures;

calculating a subsea pump flow rate required to maintain a substantially constant subsea mudlift pump inlet pressure;

calculating a surface pump pressure and a standpipe pressure; and calculating pressures at selected locations in the drilling fluid circulation system, wherein the calculated pressures may be used in the simulating circulating the formation fluid influx out of the well.

10. The method of claim 1, wherein the controlling a kick comprises:

determining a location of a top of the kick;

calculating a kick pressure in each of at least two layers defined in the two-phase mixture; and adjusting the simulation ratio to five times faster than real-time if the top of the kick passes a midpoint of a return line.

11. The method of claim 10, further comprising simulating circulating one mixture layer at a time through the subsea mudlift pump if the kick is entirely below the mud line.

12. The method of claim 10, further comprising calculating kick pressures in the wellbore and in the return line if at least part of the kick is above the mud line and at least part of the kick is below the mud line.

13. The method of claim 10, further comprising calculating kick pressures in the return line if the kick is completely above the mud line.

14. The method of claim 1, wherein the simulating controlling the kick comprises:

determining a location of a top of the kick;

calculating a current subsea mudlift pump flow rate and inlet pressure;

calculating a pressure and volume of the kick; and calculating pressures at selected locations in the drilling fluid circulation system, wherein the calculated pressures may be used in the simulating circulating the formation fluid influx out of the well.

15. The method of claim 14, further comprising determining a gas outflow rate proximate the earth's surface when the kick reaches the surface.

16. The method of claim 14, further comprising determining an effective gas outflow rate in the return line using a determined gas kick expansion rate over a selected time interval.

17. The method of claim 14, wherein the determining a location of the top of the kick comprises determining a location of a top of the two-phase mixture.

18. The method of claim 1, wherein the simulating the kick comprises:

calculating a total kick influx for a selected time duration after a selected formation has been drilled;

calculating an effective two-phase gas volume fraction of a total volume of circulating fluid, the total volume comprising the two-phase mixture and the drilling fluid;

calculating an average pressure in the two-phase mixture; and calculating pressures at selected locations in the circulation system, wherein the calculated pressures may be used in the simulating controlling the kick.

19. The method of claim 18, wherein the two-phase mixture is modeled as a slug having an effective gas fraction.

20. The method of claim 18, further comprising determining a change in a drilling fluid level in the circulation system after a kick has entered the wellbore, the change in drilling fluid level determined as:

$$\Delta h = -\frac{\Delta BHP}{0.052 \cdot \rho}$$

where Δh is the change in drilling fluid level, ΔBHP is a change in bottom hole pressure caused by the kick, and ρ is a drilling fluid density.

21. The method of claim 1, wherein the simulating a kick comprises:

selecting a location of a bottom of the kick in the wellbore;

determining a first two-phase friction pressure loss above the bottom location of the kick;

determining a kick height in the wellbore;

determining a location of a top of the kick;

determining a second two-phase friction pressure loss above the top of the kick; and determining a total friction pressure loss for the kick as a difference between the first and second determined two-phase friction pressure losses.

22. The method of claim 1, wherein the two-phase mixture comprises at least two discrete layers, each layer comprising a drilling fluid fraction and a formation fluid fraction.

23. The method of claim 22, wherein each mixture layer comprises an effective gas volume fraction.

24. The method of claim 22, wherein drilling fluid can move from a first mixture layer to an adjacent mixture layer disposed above the first mixture layer if a gas volume fraction of the first mixture layer is higher than a selected level.

25. The method of claim 24, wherein the selected level is 85% gas by volume.

26. The method of claim 22, wherein drilling fluid can move from a top mixture layer to an adjacent mixture layer disposed below the top mixture layer if a gas volume fraction of the top mixture layer is greater than 45%.

27. The method of claim 22, wherein a gas rise velocity proximate a top layer defining the top of the kick is calculated using a gas fraction of the top layer.

28. The method of claim 27, wherein gas rise velocities of other layers in the two-phase mixture are determined from an effective mixture volume of each layer.

29. A method of performing real-time well control operations, the method comprising:

simulating a drilling circulation system, the simulated circulation system comprising at least one blowout preventer, at least one isolation line, at least one surface pump, a subsea mudlift pump, drill pipe, drilling fluid, and a wellbore;

simulating drilling the wellbore at a selected rate of penetration, the simulating drilling a wellbore comprising simulating drilling selected earth formations;

detecting a kick in an operating well, the computer system operatively coupled to sensors disposed in the operating well, the sensors adapted to detect the kick and to communicate a kick depth and a kick volume to the computer system;

simulating the kick at the kick depth in the wellbore, the kick simulated as a two-phase mixture comprising drilling fluid and a formation fluid;

simulating controlling the kick using the communicated kick depth and kick volume, the simulating controlling the kick comprising:

simulating shutting the at least one blowout preventer;

simulating opening the at least one isolation line;

simulating circulating a formation fluid influx out of a well while an inlet pressure of a subsea mudlift pump is adjusted to maintain a substantially constant drill pipe initial circulating pressure;

simulating pumping drilling fluid with a kill mud weight from the surface into the well;

simulating reducing the drill pipe pressure according to a preselected drill pipe pressure decline schedule until the kill mud weight drilling fluid reaches a bottom of the well;

simulating maintaining the drill pipe pressure at a final circulating pressure after the kill mud weight drilling fluid reaches the bottom of the well by adjusting the inlet pressure of the subsea mudlift pump; and simulating circulating kill mud weight drilling fluid from the bottom of the well to the surface at the final circulating pressure;

displaying wellbore parameters via a graphical user interface operatively coupled to the computer system, the wellbore parameters comprising a drill pipe pressure, a subsea mudlift pump inlet pressure, a surface pump flow rate, a subsea mudlift pump flow rate, a formation pressure, a blowout preventer status, an isolation line status, a drilling fluid density, and a kill mud weight drilling fluid density; and using the displayed parameters to operate the drilling circulation system.

30. A method of simulating subsea mudlift drilling well control operations using a computer system, the method comprising:

simulating a drilling circulation system, the simulated circulation system comprising at least one blowout preventer, at least one isolation line, at least one surface pump, a subsea mudlift pump, drill pipe, drilling fluid, and a wellbore;

simulating drilling the wellbore at a selected rate of penetration, the simulating drilling a wellbore comprising simulating drilling selected earth formations;

simulating a kick at a selected depth in the wellbore proximate a selected earth formation, the kick simulated as a two-phase mixture comprising drilling fluid and a formation fluid;

simulating controlling the kick, the simulating controlling the kick comprising:

simulating shutting the at least one blowout preventer;

simulating opening the at least one isolation line;

simulating circulating a formation fluid influx out of a well while an inlet pressure of a subsea mudlift pump is adjusted to maintain a substantially constant drill pipe initial circulating pressure;

simulating pumping drilling fluid with a kill mud weight from the surface into the well;

simulating holding the inlet pressure of the subsea mudlift pump substantially constant until the kill mud weight drilling fluid reaches a bottom of the well;

simulating adjusting the inlet pressure of the subsea mudlift pump to maintain the drill pipe pressure at a final circulating pressure after the kill mud weight drilling fluid reaches the bottom of the well; and simulating circulating kill mud weight drilling fluid from the bottom of the well to the surface at the final circulating pressure;

displaying wellbore parameters via a graphical user interface operatively coupled to the computer system, the wellbore parameters comprising a drill pipe pressure, a subsea mudlift pump inlet pressure, a surface pump flow rate, a subsea mudlift pump flow rate, a formation pressure, a blowout preventer status, an isolation line status, a drilling fluid density, and a kill mud weight drilling fluid density; and repeating the simulating drilling the wellbore after the kick has been controlled.

31. A method of performing real-time well control operations, the method comprising:

simulating a drilling circulation system, the simulated circulation system comprising at least one blowout preventer, at least one isolation line, at least one surface pump, a subsea mudlift pump, drill pipe, drilling fluid, and a wellbore;

simulating drilling the wellbore at a selected rate of penetration, the simulating drilling a wellbore comprising simulating drilling selected earth formations;

detecting a kick in an operating well, the computer system operatively coupled to sensors disposed in the operating well, the sensors adapted to detect the kick and to communicate a kick depth and a kick volume to the computer system;

simulating the kick at the kick depth in the wellbore, the kick simulated as a two-phase mixture comprising drilling fluid and a formation fluid;

simulating controlling the kick using the communicated kick depth and kick volume, the simulating controlling the kick comprising:

simulating shutting the at least one blowout preventer;

simulating opening the at least one isolation line;

simulating circulating a formation fluid influx out of a well while an inlet pressure of a subsea mudlift pump is adjusted to maintain a substantially constant drill pipe initial circulating pressure;

simulating pumping drilling fluid with a kill mud weight from the surface into the well;

simulating holding the inlet pressure of the subsea mudlift pump substantially constant until the kill mud weight drilling fluid reaches a bottom of the well;

simulating adjusting the inlet pressure of the subsea mudlift pump to maintain the drill pipe pressure at a final circulating pressure after the kill mud weight drilling fluid reaches the bottom of the well; and simulating circulating kill mud weight drilling fluid from the bottom of the well to the surface at the final circulating pressure;

displaying wellbore parameters via a graphical user interface operatively coupled to the computer system, the wellbore parameters comprising a drill pipe pressure, a subsea mudlift pump inlet pressure, a surface pump flow rate, a subsea mudlift pump flow rate, a formation pressure, a blowout preventer status, an isolation line status, a drilling fluid density, and a kill mud weight drilling fluid density; and using the displayed parameters to operate the drilling circulation system.

* * * * *